US012420131B1

(12) United States Patent
Nayak

(10) Patent No.: US 12,420,131 B1
(45) Date of Patent: Sep. 23, 2025

(54) EXERCISE DEVICE ACTIVE BAR-STABILIZATION

(71) Applicant: Podium Fit, Inc., San Francisco, CA (US)

(72) Inventor: Subrat Nayak, San Francisco, CA (US)

(73) Assignee: Podium Fit, Inc., San Francisco, CA (US)

( * ) Notice: Subject to any disclaimer, the term of this patent is extended or adjusted under 35 U.S.C. 154(b) by 167 days.

(21) Appl. No.: 18/215,017

(22) Filed: Jun. 27, 2023

Related U.S. Application Data

(60) Provisional application No. 63/355,944, filed on Jun. 27, 2022.

(51) Int. Cl.
*A63B 21/005* (2006.01)
*A63B 21/00* (2006.01)
*A63B 24/00* (2006.01)

(52) U.S. Cl.
CPC ..... *A63B 21/0058* (2013.01); *A63B 21/153* (2013.01); *A63B 24/0087* (2013.01); *A63B 21/4035* (2015.10); *A63B 2220/20* (2013.01)

(58) Field of Classification Search
CPC ..... A63B 21/0058; A63B 21/153; A63B 24/0087; A63B 21/4035; A63B 2220/20
See application file for complete search history.

(56) References Cited

U.S. PATENT DOCUMENTS 5,645,513 A 7/1997 Haydocy et al.
5,888,172 A 3/1999 Andrus et al.
7,556,590 B2 7/2009 Watterson et al.
7,648,446 B2 1/2010 Chiles et al.
8,845,499 B1 * 9/2014 Boatwright ..... A63B 24/0062 482/116

(Continued)

FOREIGN PATENT DOCUMENTS

WO 2022212737 10/2022
WO 2022227499 11/2022

(Continued)

OTHER PUBLICATIONS

"Science—Speede Fitness", https: speede.fit pages science, (Accessed Mar. 4, 2022), 4 pgs.

(Continued)

*Primary Examiner* — Sundhara M Ganesan
(74) *Attorney, Agent, or Firm* — Schwegman Lundberg & Woessner, P.A.

(57) ABSTRACT

A method of operating an exercise device including a first motor, a second motor, a first spool coupled to the first motor, a second spool coupled to the second motor, a first cable coupled to the first spool for winding onto and off the first spool in response to a torque applied by the first motor, a second cable coupled to the second spool for winding onto and off the second spool in response to a torque applied by the second motor, the method comprising: determining a first value related to an extension of the first cable from the first spool, determining a second value related to an extension of the second cable from the second spool, determining a difference between the first and second values, and adjusting the torque applied by at least one of the motors based on the difference between the first value and the second value.

20 Claims, 17 Drawing Sheets

(56) References Cited

U.S. PATENT DOCUMENTS

| | | | | |
|---|---|---|---|---|
| 8,900,099 | B1 | 12/2014 | Boyette | |
| 9,539,458 | B1 | 1/2017 | Ross | |
| 2002/0055424 | A1 | 5/2002 | Brown | |
| 2006/0269251 | A1 | 11/2006 | Hsu | |
| 2008/0051256 | A1 | 2/2008 | Ashby et al. | |
| 2008/0153670 | A1 | 6/2008 | Mckirdy et al. | |
| 2010/0048356 | A1 | 2/2010 | Hamilton | |
| 2010/0069202 | A1 | 3/2010 | Olsen | |
| 2010/0234184 | A1 | 9/2010 | Le et al. | |
| 2010/0262048 | A1 | 10/2010 | Shinomiya et al. | |
| 2011/0082006 | A1 | 4/2011 | Ishii et al. | |
| 2011/0165995 | A1 | 7/2011 | Paulus et al. | |
| 2011/0251021 | A1 | 10/2011 | Zavadsky et al. | |
| 2014/0194250 | A1 | 7/2014 | Reich et al. | |
| 2014/0194251 | A1 | 7/2014 | Reich et al. | |
| 2015/0080184 | A1 | 3/2015 | Boyette | |
| 2016/0256745 | A1 | 9/2016 | Brammer | |
| 2016/0332019 | A1 | 11/2016 | Rollins | |
| 2018/0021616 | A1 | 1/2018 | Orady et al. | |
| 2018/0214729 | A1 | 8/2018 | Rubin et al. | |
| 2019/0076691 | A1 | 3/2019 | Smith | |
| 2019/0344115 | A1* | 11/2019 | Neuhaus | A63B 21/0058 |
| 2020/0047030 | A1 | 2/2020 | Ward et al. | |
| 2020/0047031 | A1 | 2/2020 | Orady et al. | |
| 2020/0261771 | A1 | 8/2020 | Belson et al. | |
| 2020/0276465 | A1 | 9/2020 | Orady et al. | |
| 2020/0298049 | A1 | 9/2020 | Valente et al. | |
| 2020/0316424 | A1 | 10/2020 | Orady et al. | |
| 2020/0330847 | A1 | 10/2020 | Orady et al. | |
| 2021/0069553 | A1 | 3/2021 | Belson et al. | |
| 2021/0111646 | A1 | 4/2021 | Rubin | |
| 2021/0128978 | A1 | 5/2021 | Gilstrom et al. | |
| 2021/0170212 | A1 | 6/2021 | Lafrance et al. | |
| 2021/0170213 | A1 | 6/2021 | Orady et al. | |
| 2021/0170214 | A1 | 6/2021 | Orady et al. | |
| 2021/0236876 | A1 | 8/2021 | Gregory | |
| 2021/0291021 | A1 | 9/2021 | Orady et al. | |
| 2021/0379436 | A1 | 12/2021 | Orady et al. | |
| 2021/0394011 | A1 | 12/2021 | Neuhaus et al. | |
| 2021/0394023 | A1 | 12/2021 | Belson et al. | |
| 2022/0001240 | A1 | 1/2022 | Rubin et al. | |
| 2022/0032114 | A1 | 2/2022 | Valente et al. | |
| 2022/0184452 | A1 | 6/2022 | Valente et al. | |
| 2023/0067732 | A1* | 3/2023 | Neuhaus | A63B 21/154 |
| 2023/0149762 | A1 | 5/2023 | Willison et al. | |
| 2023/0201652 | A1 | 6/2023 | Ye | |
| 2023/0405404 | A1 | 12/2023 | Belsham et al. | |
| 2024/0189651 | A1 | 6/2024 | Drayer et al. | |
| 2025/0041647 | A1* | 2/2025 | Mooney | A63B 21/4043 |

FOREIGN PATENT DOCUMENTS

| | | |
|---|---|---|
| WO | 2023069724 | 4/2023 |
| WO | 2023102016 | 6/2023 |

OTHER PUBLICATIONS

"Speede—Frequently Asked Questions", https: speede.fit pages faq, (Accessed Mar. 4, 2022), 3 pgs.

"Speediance Works", https: www.speediance.com confirm?id=2, (Accessed Mar. 4, 2022), 5 pgs.

Lopez, Ricardo, et al., "A Lower Limb Exoskeleton with Hybrid Actuation", 2014 5th IEEE RAS & EMBS International Conference on Biomedical Robotics and Biomechatronics (BioRob), Sao Paulo, Brazil, (Aug. 12, 2014), 7 pgs.

Toro, David, "Introduction to Brushless DC Motors", Diodes Incorporated, AN1164—Rev 1, Application Note, [Online]. Retrieved from the Internet: <https://www.diodes.com/assets/Uploads/AN1164-BLDC-Motors.pdf>, (May 2021), 9 pgs.

* cited by examiner

EXERCISE DEVICE ACTIVE BAR-STABILIZATION

RELATED APPLICATION DATA

This application claims the benefit of U.S. Provisional Patent Application No. 63/355,944 filed on Jun. 27, 2022, the contents of which are incorporated herein by reference as if explicitly set forth.

TECHNICAL FIELD

This patent application generally relates to the field of exercise equipment. More specifically, this patent application relates to a dynamic cable-actuated resistance training device that mimics traditional free weights in use.

BACKGROUND

Exercise is known to be a big enabler of physical and mental well-being. Resistance training, also known as strength or weight training, has significant health benefits, but can also be challenging for a typical person to do correctly or well. Exercising the whole body is good for overall wellbeing, rather than just exercising a few isolated muscles. Compound exercises that engage multiple muscle groups are the most beneficial and time-efficient exercises. Resistance training can also be used for cardiovascular training when done with relatively lower resistance at relatively higher reps over a relatively longer period of time.

There are many known types of exercise equipment for doing cardiovascular training in an indoor setting such as treadmills, stationary spin bikes, rowing machines, stair climbers etc. that have some sort of mechanism to vary the resistance mechanically or magnetically or electro-magnetically.

Resistance training is typically performed by doing body-weight exercises, using free weights, using resistance stretch bands, or using weight-training machines with weights driven through stabilized rigid linkages, or cable machines with weights driven through cables and pulleys, but these suffer from various disadvantages. For body-weight exercises, the resistance doesn't always match the strength of the muscles being engaged. Working with free weights can be potentially hurtful, damaging to the surrounding environment, noisy, or require heavy and expensive safety equipment. Cable machines and weight-training machines require a significant amount of space. While one cable machine can do many different exercise, weight-training machines are usually made for a specific exercise requiring a significant number of different devices to provide a full body workout. Stabilization inherent in weight-training machines can prevent the engagement of all the muscle groups needed to stabilize movements under load in real life activities. Resistance stretch bands usually act as linear springs, in which the force increases with extension, so that the force is not freely and fully controllable. Some magnetic and flywheel mechanisms exist that can vary the resistance to some extent, but the resistance usually increases with increase in speed of the movement and is thus not sufficiently controllable.

There has been growing interest in exercising at home, instead of commuting to the gym and sharing equipment. Exercise equipment made for the home needs to be affordable, quiet, time-efficient, light weight, portable and space-efficient. It can however be a challenge for a user to stay consistent enough to reap the health benefits. Users can be kept motivated through various digital methods like content and feedback on a digital screen, data logging, progress tracking, live group classes, video communication with a coach and/or other users.

BRIEF DESCRIPTION OF THE SEVERAL VIEWS OF THE DRAWINGS

Some examples of the present disclosure are illustrated by way of example and not limitation in the figures of the accompanying drawings, in which like reference numbers indicate similar elements. To easily identify the discussion of any particular element or act, the most significant digit or digits in a reference number refer to the figure number in which that element is first introduced.

DETAILED DESCRIPTION

Figure 1:
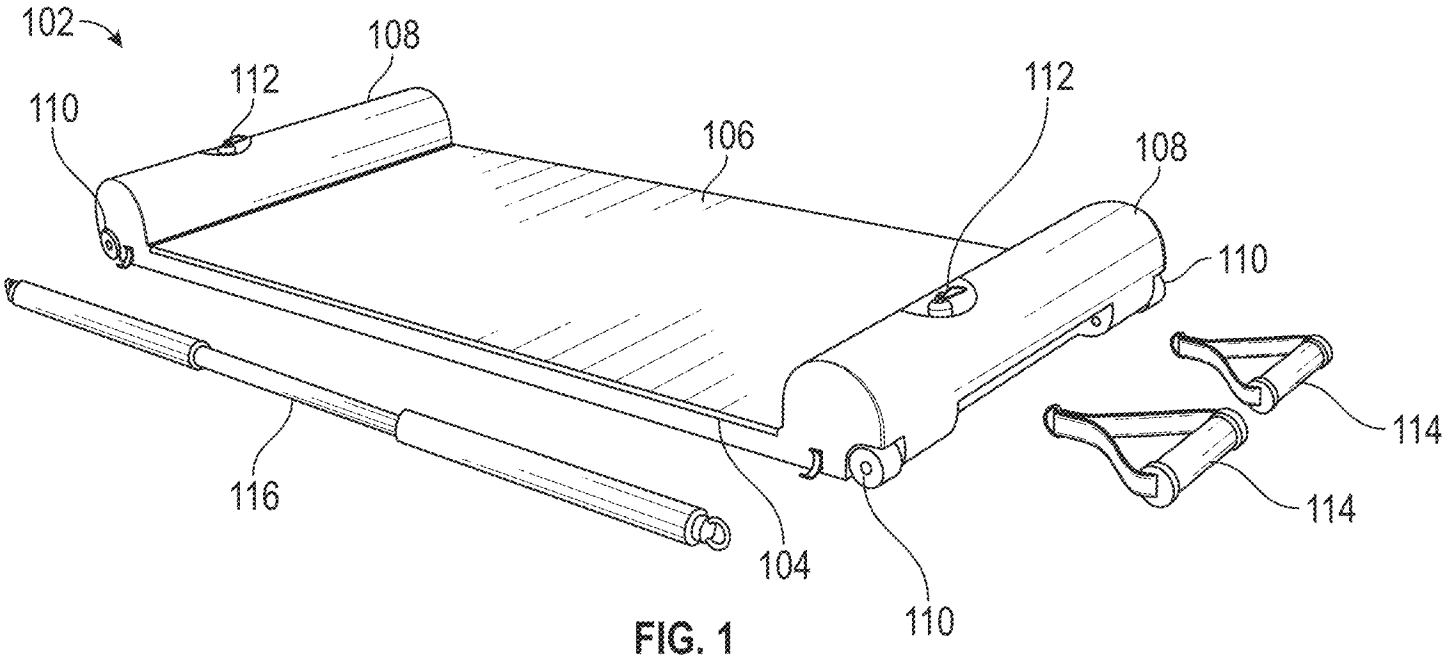
FIG. 1 is a perspective view of an exercise device, according to some examples.

Humans cannot accurately sense and create accurate forces with their limbs, especially with their most dexterous limbs i.e., their hands. It is possible to tell the difference between a heavy weight in one hand versus a light a light weight in another hand, but it is very difficult for a human to tell the difference between two weights that are slightly different, using one hand. To coordinate complex motions and decide how much force to apply, humans use their eyes to sense position and velocity and use a closed loop control system that drives their limbs to create certain variable amounts of force, to ensure a desired position and velocity of an object being moved or manipulated.

This phenomenon becomes prominent when multiple limbs are handling separate loads or are sharing the load of the same physical object that is being moved or manipulated.

While exercising with free weights, the two common free weights are dumbbells and barbells. Dumbbells are designed to be held one in a hand, while a barbell is designed to be held by two hands using a central bar.

There is a big difference in how much weight the same human can lift when comparing a barbell against two dumbbells. For example, an overhead press can be done with one barbell held using both hands, which is called a barbell overhead press. Alternatively, an overhead press can also be done with two barbells, one in each hand, which is called a dumbbell overhead press. For instance, if a person can lift a maximum of 100 lbs of weight during a barbell overhead press, they will most likely not be able to lift two 50 lb dumbbells, one in each hand, during a dumbbell overhead press.

Another way to compare this phenomenon is based on time under tension rather than weight lifted. For instance, if a person can lift a 100 lb barbell for 5 minutes, they will most likely not be able to lift two 50 lb. dumbbells for the 5 minutes. The two exercises have a major difference in terms of which muscles are being used.

There are different kinds of muscles being used from moment to moment. Some are the big strong load-bearing muscles and there are also auxiliary smaller stabilizer muscles that enable a particular movement. The barbell is inherently more stable as the two hands and arms are working together as a team to share the load, making it easier to lift. Two separate dumbbells are not connected to each other, so although the same two hands and arms are being used to lift the dumbbells, and the same load bearing muscles are doing most of the work, the smaller stabilizer muscles are doing more work to keep both dumbbells balanced and stable.

The smaller stabilizer muscles tend to fatigue quickly and the person loses the ability to lift the dumbbells as soon as the stabilizer muscles have fully fatigued, even if the big load bearing muscles haven't fully fatigued. While in the case of barbells, the load bearing muscles are doing most of the work while the stabilizer muscles are less engaged, which makes the person lift more or lift longer until the big load bearing muscles are fully fatigued even though the smaller stabilizer muscles may not have become fully fatigued.

There are benefits to exercising both kinds of muscles to the point when they are fully fatigued. The stabilizer muscles help the body with various functional movements, while load bearing muscles define a person's full strength. The load bearing muscles also create more lactate buildup and hence cause a higher production of human growth hormone, which has many other metabolic health benefits. Hence, a balanced exercise regimen includes exercising with both dumbbells as well as barbells.

A barbell is made up of a central heavy bar (weighing in the range of 25-45 lbs) to which weight plates are attached on each side. The inertia of the barbell is directly proportional to its mass. Hence, a 200 lb barbell will have higher inertia than a 100 lb barbell. The high inertia of the barbell helps keep the barbell stabilized as forces are applied with two different hands to lift the barbell. Slightly different forces may be being applied and varied through each hand as the barbell is lifted to ensure that the barbell stays level.

A person who is exercising feels and sees the barbell position and speed and accordingly applies higher force with the hand that is lifting the side that is slightly lower compared to the hand that is lifting the side that is higher. Such a maneuver has a stabilizing result that results in the bar being maintained in a more level position. When the forces applied by each hand are deliberately varied then these forces can accelerate or decelerate the respective side of the bar, creating the phenomena of overshoot. The resulting overcompensating and destabilization stresses the smaller stabilizer muscles more. Staying stabilized stresses the big load bearing muscles more.

The high inertia of the barbell also makes it harder to accelerate or decelerate, which gives the human sense of perception a bit more time to react and hence, a barbell is lot easier to stabilize.

In an exercise device as described herein, where the force is being generated by two cables, a bar can be hooked to two cables to act as a barbell, or two separate handles can be hooked to each cable to act as two dumbbells. In such an application, the bar or the two handles are very light because most of the resistance for the exercise is being created by tension in the cables either by a motor, strength cables, or free weights.

In such a case, the bar has very little inertia and hence, it lacks the stabilizing nature of a barbell. A light bar hooked to two cables at its ends starts feeling similar to two dumbbells, where the person is stressing the stabilizer muscles proportionally harder than the load bearing muscles. Trying to lift heavy weights (or simulated weights) with such a setup can end up feeling shaky and uncomfortable. It becomes more difficult to fully fatigue the load bearing muscles or to lift weights at the higher range of the person's capacity.

This is very limiting in cable machines, even in current electromagnetically-driven cable machines. One such device has an electric motor with a differential gear box to create tension in two cables, which ends up creating an exactly equal tension in each cable. Reducing the torque applied by the motor reduces the tension in both cables equally. Applicant has identified a need for two independent force creating mechanisms that are able to change the forces in each cable independently.

The exercise devices disclosed herein use two separate motors with separate inverters and a control interface that each drive their own separate spool mechanism, which independently regulates the tension in the two cables. Each motor, with its directly-coupled spool, has its own high-resolution encoder to measure position and speed of the motor and then, by knowing the helix diameter of the spool, the position and speed of the end point of the cable that attaches to the handles or at each end of the bar can be determined.

This position and velocity information is somewhat similar to what humans see and feel. If there is a mismatch in position and velocity on the two sides, it implies a destabilized and undesirable state. So, a closed loop control system can be formed that strives to keep the mismatch in position and velocity on the two sides to as close to zero as possible.

A Proportional, Integral and Derivative (PID) controller is a commonly used linear closed loop control algorithm that takes an input from a sensor and drives an output to an actuator based on an amplifier gain value. The gain of the amplifier is tuned to provide an optimal response time.

A high gain in the PID controller used to control the forces in the cables in the disclosed exercise device will make the system more aggressive, which creates much higher difference in two forces to try to quickly stabilize the bar, but it can also end up creating an overshoot that ends up being uncomfortable, jittery and destabilizing. A low gain can make the system too sluggish, which creates a small difference in two forces which takes too long to stabilize the bar and proves to be ineffective.

Accordingly, the gain is tuned once to cover a wide range of forces and left fixed as a system parameter. Alternatively it can be provided to the user as a variable that can be adjusted, buts it still needs to be within certain maximum and minimum values so that the user doesn't set it beyond limits that may cause undesirable and ineffective behavior such as oscillations or jerky movements.

A user has a similar internal control system when applying more force to one hand than the other to keep the bar stabilized. But humans are not as precise in the process when lifting high weights or after being partially fatigued, and any effort made by the user to try to self-stabilize ends up fatiguing the smaller stabilizer muscles before the big load bearing muscles are fully fatigued.

The dual motor control systems enable the exercise device disclosed herein to change the tension in the two cables at speeds much higher than humans can sense, to ensure the user is being almost equally challenged on each side, thus making the bar feel very stable as if it was a typical weighted barbell.

For this stabilizer control system to work alongside the user's internal stabilizer control system, it has to run at much higher speeds than typical human reaction speeds. The use of a low inertia cylindrical spool, low inertia cylindrical rotor, zero backlash spool mechanism, low friction bearings, low inductance motor windings and a high switching frequency enables a very quick response time that is well above a 100 Hz update rate, and possibly as high as 1000 Hz, while humans cannot perceive faster than 10 Hz. The control system does not need or use a direct force sensor, almost similar to how humans are able to balance/stabilize the bar without knowing the forces that they are applying precisely.

FIG. 1 is a perspective view of an exercise device 102 according to some examples. The exercise device 102 includes a base comprising a chassis 104 and a platform 106, spaced-apart left and right side pods 108, wheels 110, and attachment points 112 to which a workout element, such as handles 114 or a bar 116, can be attached for use in resistance training. The exercise device 102 will typically be placed on the ground, although it can be mounted to the wall or another structure. As will be described in more detail below, the attachment points 112 are coupled to two cables 202 that are housed in the side pods 108.

Figure 3A:
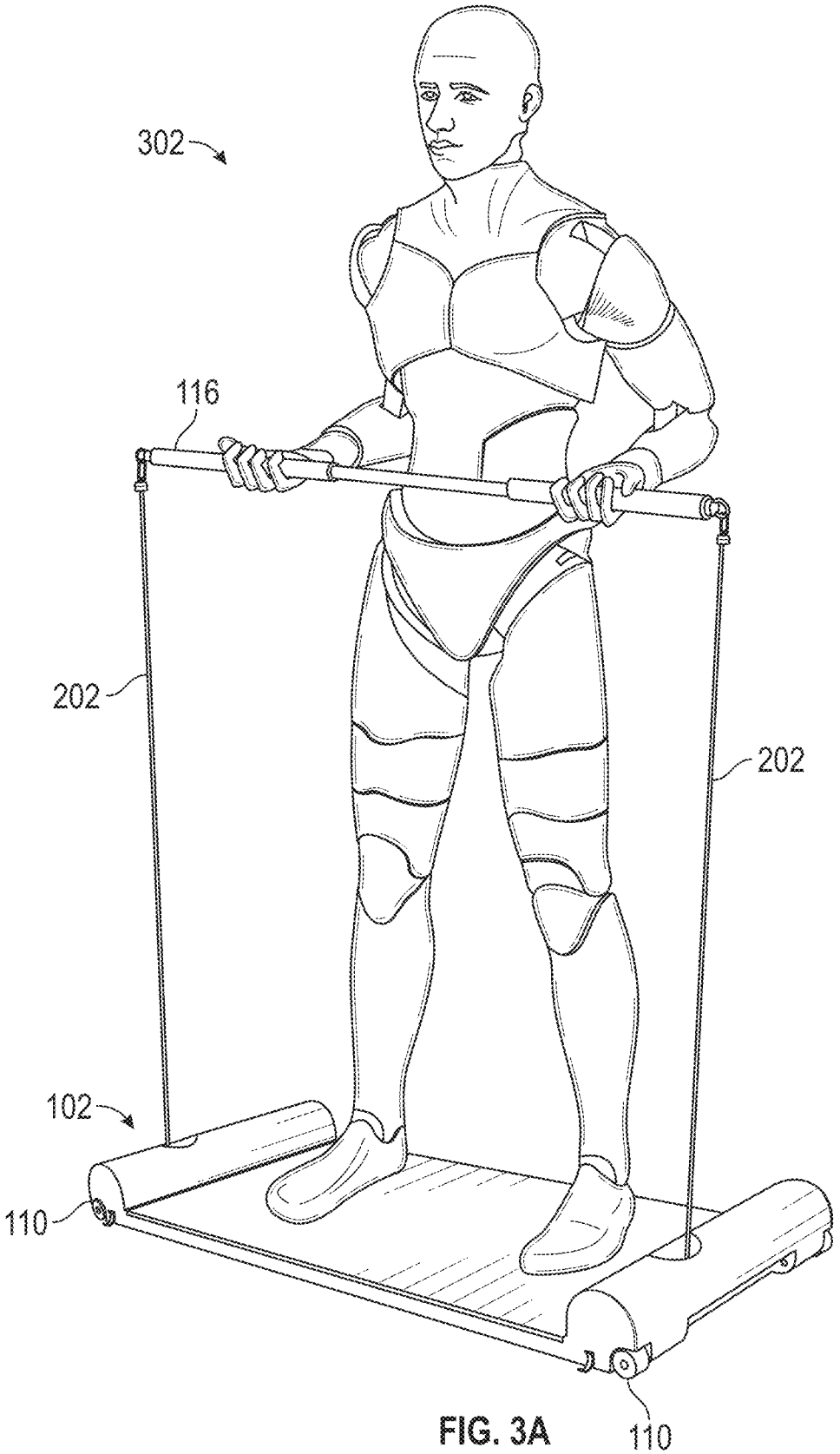
FIG. 3A, FIG. 3B and FIG. 3C illustrate strength exercises that can be performed using the exercise device according to some examples.
Figure 3B:
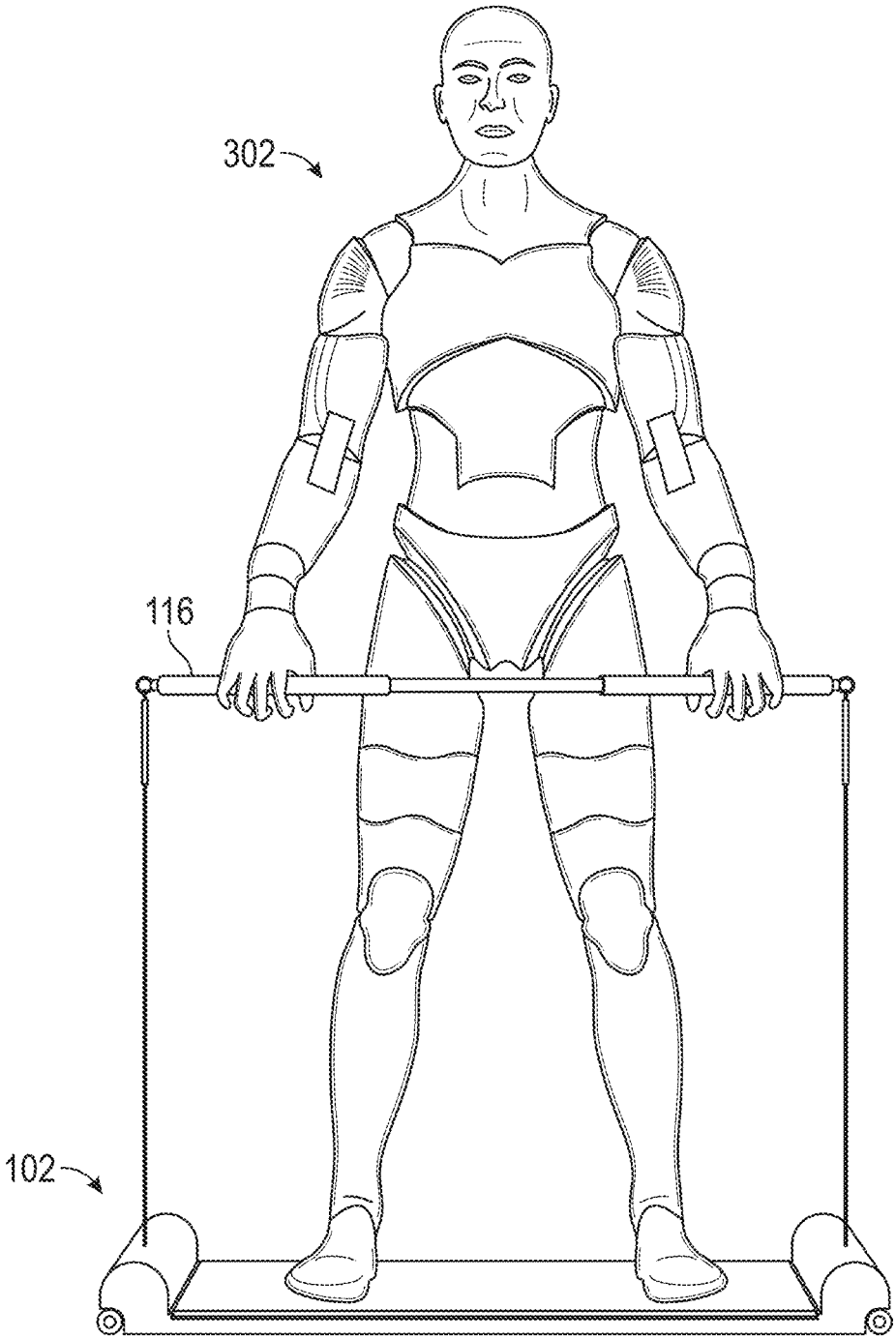
Figure 3C:
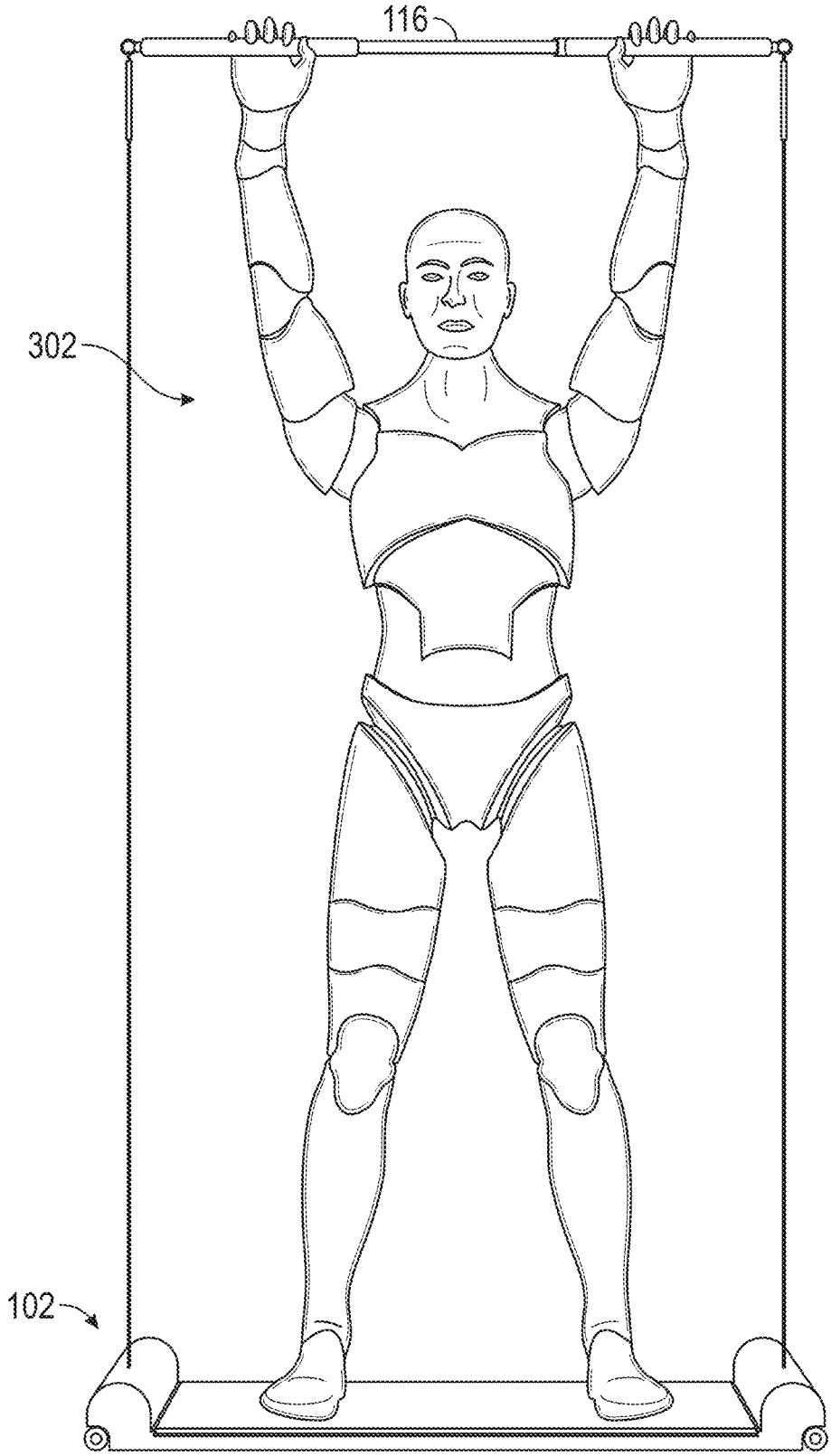

The top of the platform 106 is planar and fairly low in height (in the range of 2-3 inches) when the exercise device 102 is on the ground, which mitigates any risk or fear of falling off of a high step during exercise, and makes the exercise device 102 safer. A user can stand, sit, kneel, or lie on the platform 106 depending on the exercise, with the user's weight holding the exercise device 102 down while the user lifts in an upward direction using the bar 116 or the handles 114 as shown in FIG. 3A, FIG. 3B and FIG. 3C. Additionally, since the bar 116 overlaps the side pods 108 on both sides, if a user drops the bar 116 it will hit the side pods 108 before it hits the user's feet.

The chassis 104 is supported by wheels 110. There may be two wheels 110 on just one side so that the exercise device 102 can be picked up from the other side to engage the wheels 110, which permits the exercise device 102 to be moved into and out of storage like a rolling suitcase, without having to lift the full weight of the exercise device 102. In other examples, the device may have four wheels 110 (two on each side as shown in FIG. 1). In some cases, the wheels do not extend below the bottom of the chassis 104 and require that a side of the exercise device 102 be lifted up on one side to engage the wheels on another side.

In other examples, the wheels 110 are spring-loaded and protrude below the chassis 104 when the exercise device 102 is not in use, but are pushed up into the chassis 104 when a certain minimum weight of the user rests on the platform 106, which ensures that the exercise device 102 is securely engaged with the ground when used. This provision of wheels 110 permits the exercise device 102 to be rolled away conveniently, for storage under a bed or couch for example.

In the case of spring-loaded wheels 110, one or more of the wheels 110 may be attached to a sensor to detect whether it or they are pushed up into the chassis by the user's weight. Detection of these two states of the wheels 110 may be used to enable full functioning of the exercise device 102 when the wheels are retracted and to disable full functioning of the exercise device 102 when the wheels are extended. In particular, the exercise device 102 can use these two states to disable tension in the cables provided by the motors 512 (see FIG. 5) when the user's weight is not on the platform, so that if the user steps off the platform 106 during an exercise or is not on the platform when a handle 114 or the bar 116 is lifted, the platform 106 will not be lifted into the air under the power of the motors. Alternatively, sensors could be provided in the platform 106 or elsewhere to detect the user's weight, to enable or disable functioning of at least the motors 512 based on detecting the presence or absence of the user's weight.

In other examples, the wheels 110 on one or both of the sides may be casters, or there may be a single caster wheel on one side and two normal wheels on the other side. Providing at least one caster wheel allows the user to rotate the exercise device 102 while on the ground, which helps in moving the exercise device 102 under beds and couches that may have little clearance under them.

Figure 2A:
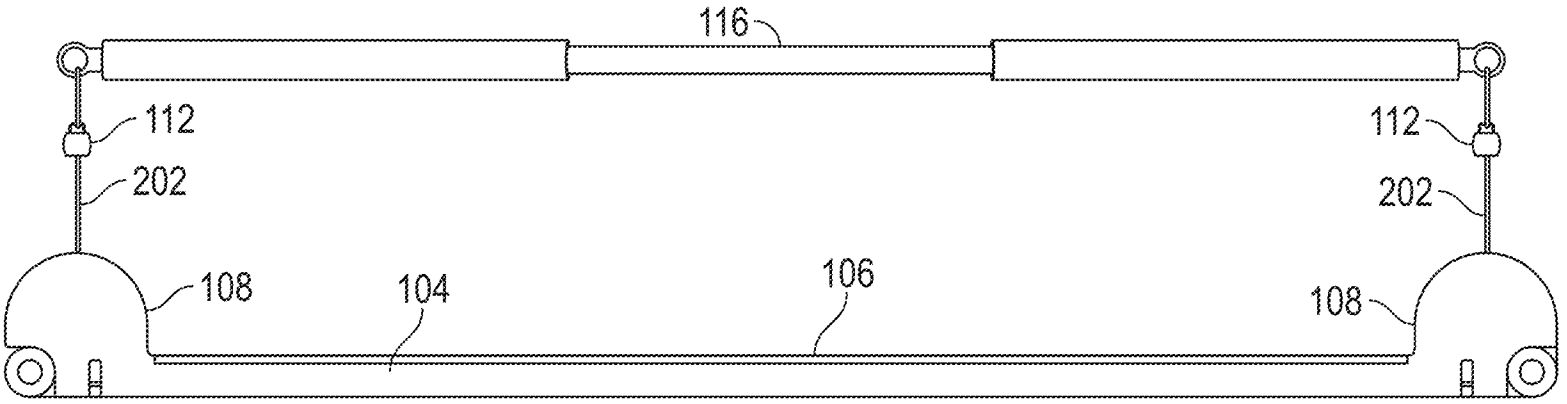
FIG. 2A and FIG. 2B show two configurations of the exercise device in use, according to some examples.
Figure 2B:
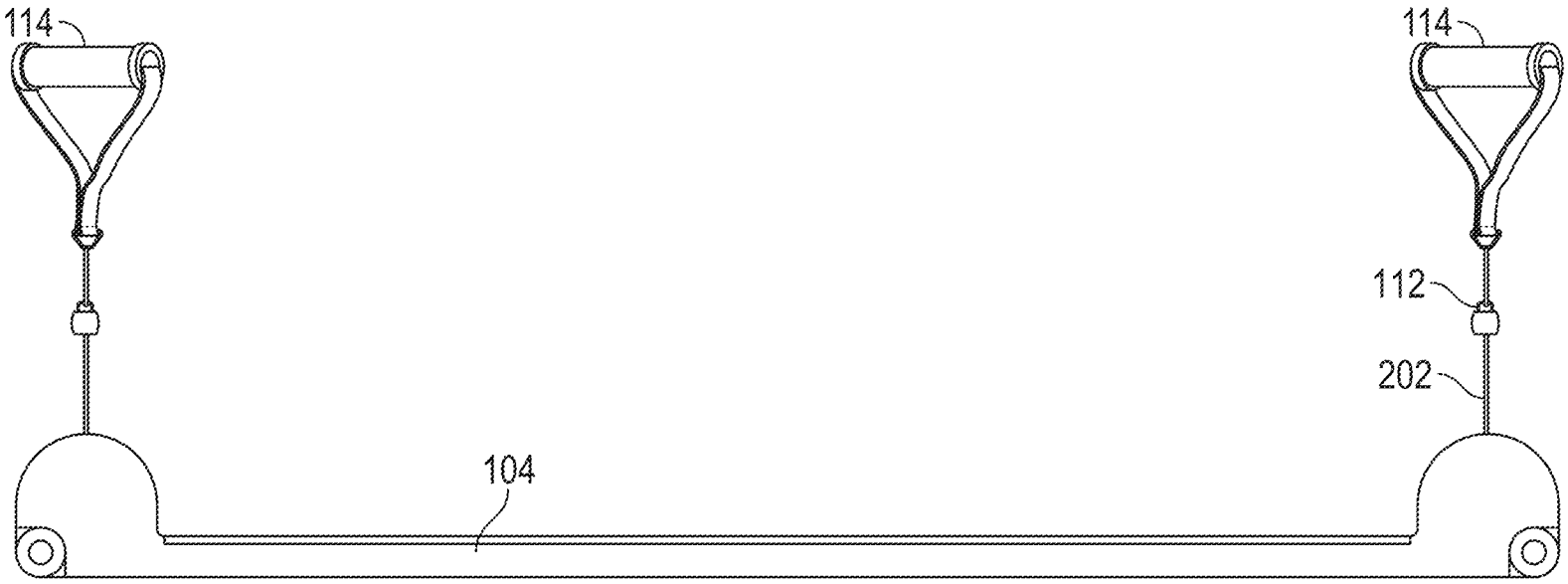

FIG. 2A and FIG. 2B show two configurations of the exercise device 102 in use, according to some examples. As shown in FIG. 2A and FIG. 2B, by attaching the bar 116 or the handles 114 to the attachment points 112, the cables 202 can be pulled up vertically or at a certain angle from vertical, under tension that is provided by two motors, one in each side pod 108. The tension in in each cable 202 provides the resistance for the training. The exercise device 102 is designed to mimic free weights like barbells, dumbbells, and so forth.

As shown in FIG. 2A, when the bar 116 is attached to the cables 202, a user can train as if the bar 116 is a barbell. Or, as shown in FIG. 2B, when the two handles 114 are attached to the attachment points 112, they can act independently to be used to train like two dumbbells. Other attachments may also be provided, like a short bar with one attachment point in the middle, a waist belt with two attachments on each side, an ankle/wrist strap with one attachment point, and so forth, can also be used to connect to one or both of the attachment points 112 to provide a variety of different workouts.

Hundreds of different exercises can be done to create a full-body workout using a barbell and two dumbbells. Accordingly, the exercise device 102 can be used to do many different exercise for full body resistance training. Since the two cables 202 can operate independently and with different tension forces, which can also vary dynamically, a user can do many different balance and stabilization resistance exercises with the exercise device 102 as well.

FIG. 3A (bicep curls), FIG. 3B (deadlift) and FIG. 3C (overhead press) illustrate three different strength exercises that can be performed by a user 302, using the exercise device 102 according to some examples.

Figure 4A:
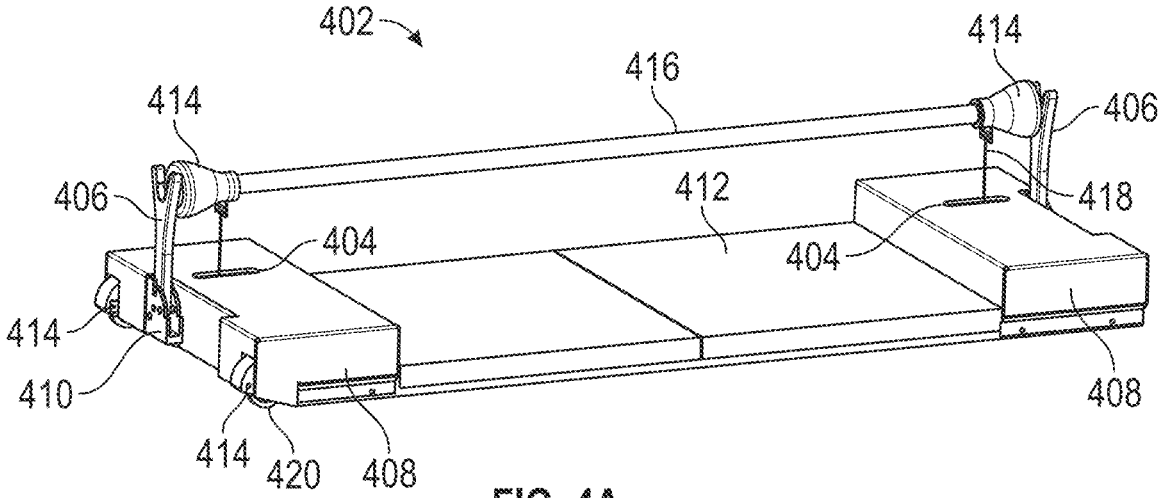
FIG. 4A and FIG. 4B show two configurations of a second version of the exercise device, according to some examples.
Figure 4B:
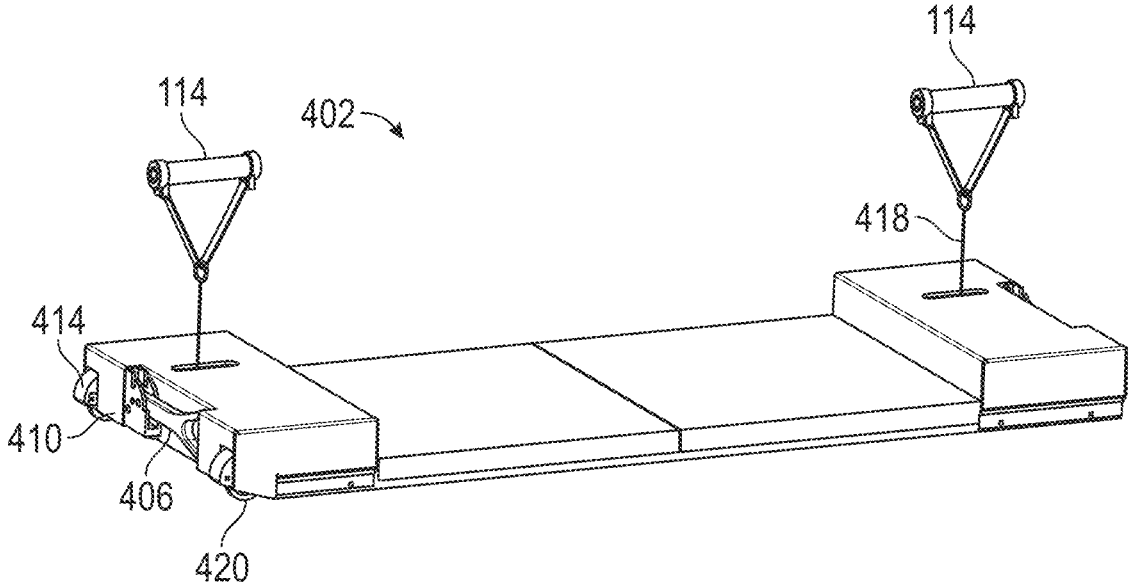

FIG. 4A and FIG. 4B show two configurations of a second version of the exercise device, according to some examples. The exercise device 402 in this case has rectangular side pods 408. Each side pod 408 has a slot 404 defined therein that permits side-to-side movement of each cable 418 in use. A Y-shaped bar holder 406 is rotatably coupled to each side pod 408 by means of a bracket 410. The bar holders 406, when in the vertical position shown in FIG. 4A, hold a bar 416 at a defined height above the platform 412, which makes it easier for the user to place their feet in alignment under the bar 416, as well as to permit more convenient grasping of the bar without having to lean all the way down to pick the bar off the platform or off the side pods 408. A user can break form if they need to lean all the way down to the pick the bar 416 up off the platform 412, which may lead to injury over a period of time.

Foot position relative to the points at which the cables 418 exit the side pods 408 is important for optimal form and to reduce the risk of injury. For example, if the bar 416 had to be picked from the platform 412, a user would not have room to locate their foot right under the bar 416 initially, which would make them stand further backwards on the platform next to the bar 416. This would either require the user to move forward after the bar 416 had been raised, or do the exercise with feet not in an optimal position, which will in turn cause the user to do the exercise in a nonoptimal form.

As shown in FIG. 4B, the bar holders 406 can be rotated out of the way to a horizontal position adjacent to the side pods 408 to facilitate unobstructed use of the handles 114 with the exercise devices 402.

Also shown in FIG. 4A and FIG. 4B are stops 414 above the wheels 420 on the side pod 408 on the left side, to assist with moving and storage of the exercise device 402.

Figure 5:
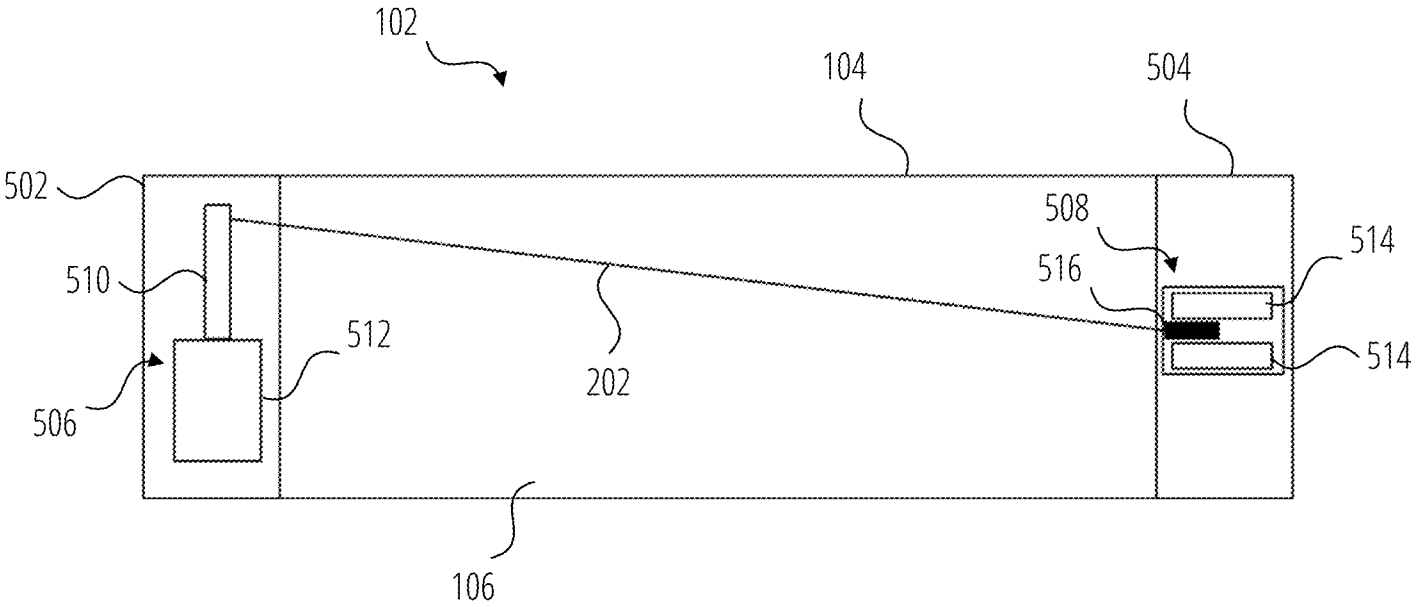
FIG. 5 illustrates the arrangement of components inside the exercise device to provide cable tension and management according to some examples.

FIG. 5 illustrates the arrangement of components inside the exercise device 102 to provide cable tension and management according to some examples. FIG. 5. is a schematic top view of the exercise device 102 showing the position of a retraction mechanism 506 in a left side pod 502 and a cable guide 508 in the right side pod 504. For purposes of clarity, the components are only described with reference to the cable 202 that exits the right side pod 504. It will be appreciated that the arrangement of the illustrated components is mirrored for the cable that exits the left side pod 502, but with the retraction mechanism in the right side pod 504 facing in the opposite direction so that the cables crisscross underneath the platform with a small clearance between the cables and an underside of the platform. This configuration of retraction mechanisms 506 and cable guides 508 in opposite side pods with the cables passing in opposite directions allows a low platform height, which just needs to be sufficiently high to allow adequate cable clearance.

An example of the cable guide 508 is described in more detail below with reference to FIG. 6, FIG. 7, and FIG. 8, while examples of the retraction mechanisms 506 are described in more detail below with reference to FIG. 9 and FIG. 10.

The retraction mechanism 506 includes an electric motor 512 and a directly-coupled long tubular threaded spool 510 onto which the cable 202 winds and unwinds in use of the exercise device 102, under torque that is applied to the threaded spool 510 by the motor 512. The cable 202 passes through the chassis 104 under the platform 106 from the threaded spool 510 to the cable guide 508. The threaded spool 510 is a zero-backlash mechanism to convert torque to tension, which may sometimes be powered manually or by an electric motor. An electric motor can also be called an electro-magnetic mechanism that uses electricity and magnetism to create torque.

The cable guide 508 in turn comprises a pulley 516 that receives the cable 202 from the retraction mechanism 506 and guides it upwards so that it is oriented generally vertically and can be attached via its attachment point 112 (not shown) to a handle 114 or the bar 116. Also provided are two rollers 514 that permit movement of the cable in a forward or backward direction (up or down in FIG. 5) relative to the platform 106.

Figure 6:
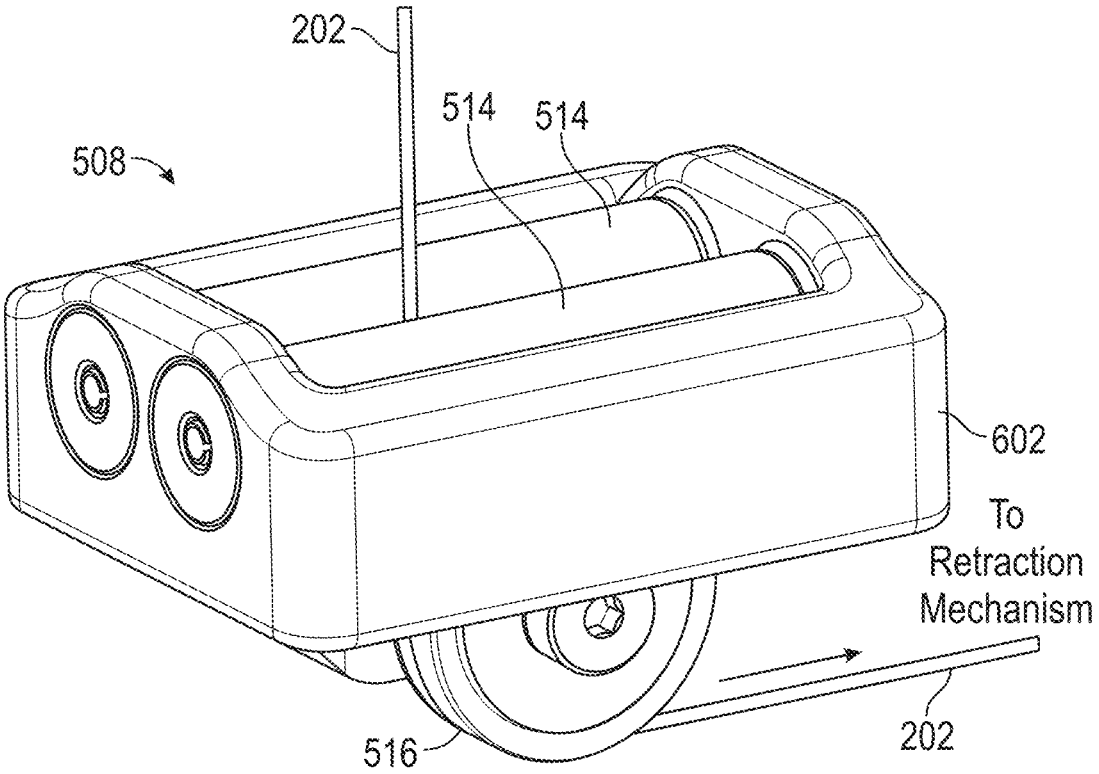
FIG. 6 is a perspective view of the cable guide of FIG. 5 according to some examples.

FIG. 6 is a perspective view of the cable guide 508 of FIG. 5 according to some examples. The cable guide 508 includes a housing 602 within which the two rollers 514 are rotationally mounted with the cable 202 exiting the housing 602 between the rollers 514. Below the housing, the pulley 516 receives the cable from the direction of the retraction mechanism 506 and turns it upward towards the attachment point 112 (not shown) where it can be attached to a bar 116 or a handle 114. The rollers 514 and the pulleys 516 are mounted to the housing using sealed ball bearings to provide quiet and low-friction movement of the cable 202. The elongated rollers 514 are parallel to each other and oriented in a direction across the exercise device 102 with a gap between them through which the cable passes. The pulley 516 is located underneath the gap between the rollers 514.

Figure 7:
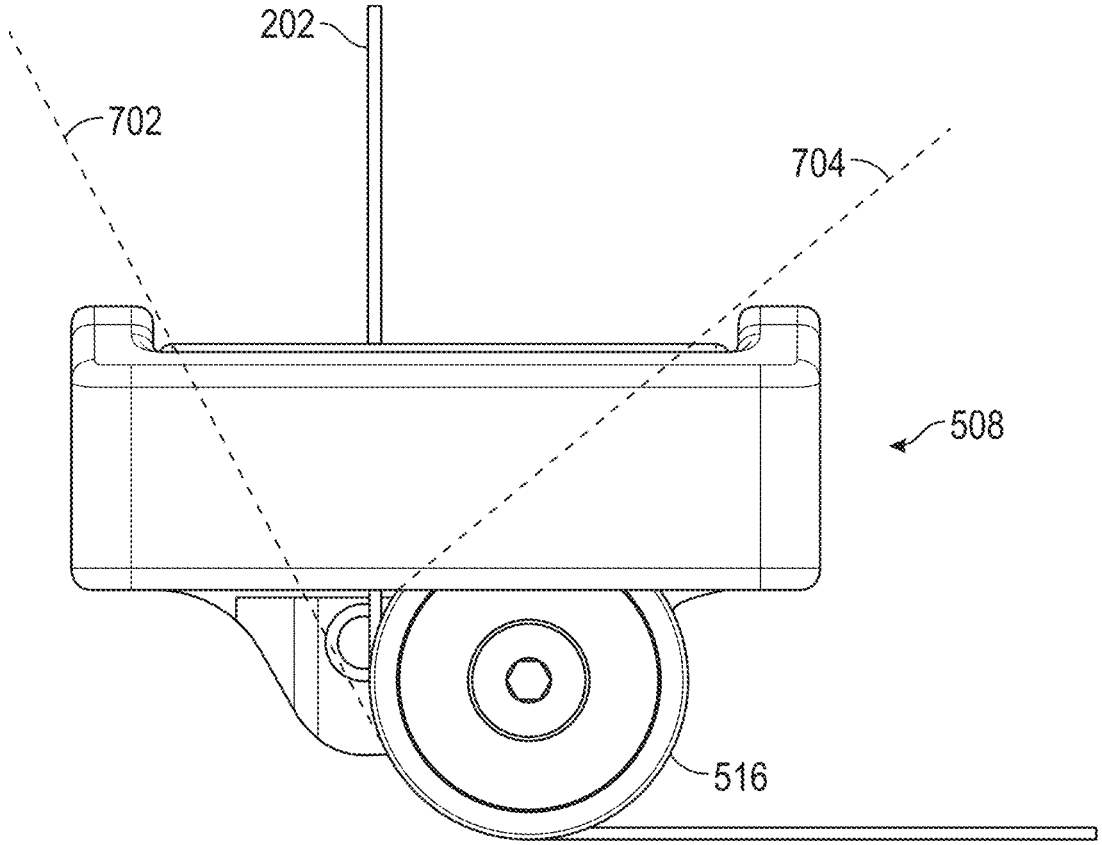
FIG. 7 is a front view of the cable guide of FIG. 5 according to some examples.

FIG. 7 is a front view of the cable guide 508 of FIG. 5 according to some examples. As can be seen, the arrangement of the rollers 514 and the pulley 516 permit functional side-to-side movement of the cable 202 between an outer limit 702 and an inner limit 704 within which the movement of the cable 202 does not interfere with the housing 602. The pulley 516 is positioned such that the vertical exit point of the cable 202 from the housing is offset to towards the outside of the exercise device 102 (away from the platform 106) so that the angle between vertical and the inner limit 704 is greater than the angle between vertical and the outer limit 702, since in use the handles 114 are likely to extend further over the platform 106 than away therefrom.

Figure 8:
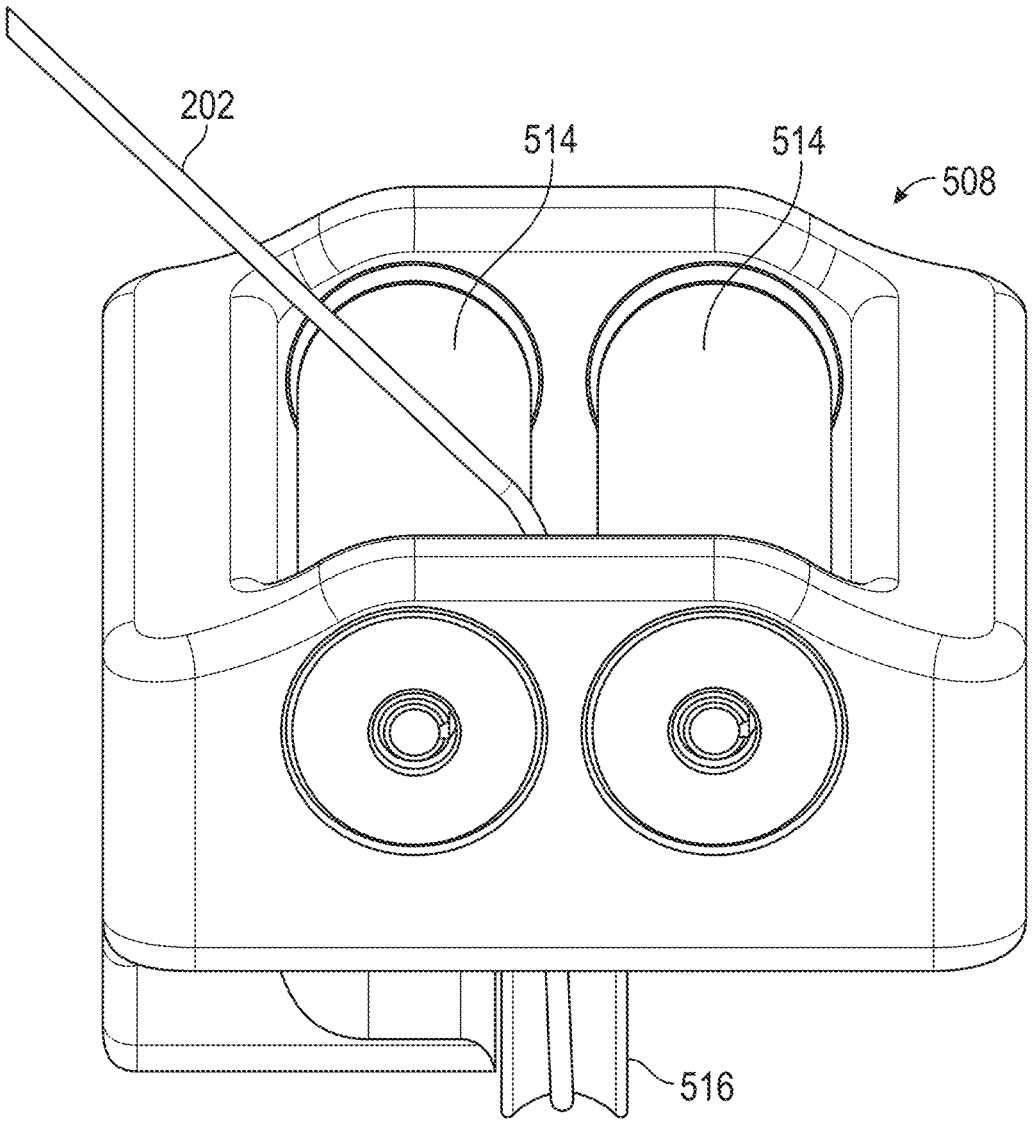
FIG. 8 is a side perspective view of the cable guide of FIG. 5 according to some examples.

FIG. 8 is a side perspective view of the cable guide 508 of FIG. 5 according to some examples. The arrangement of the pulley 516 below the gap between the roller 514 can clearly be seen in FIG. 8. Also, it can be seen that the rollers 514 permit the cable 202 to move functionally forward and backward over the exercise device 102 without it interfering with the housing. The arrangement of the rollers 514 and the pulley 516 ensure that the cable 202 can be moved not only in a vertical direction but also within a certain range of angles from the vertical in all four directions (left, right, forward, and backward).

Figure 9:
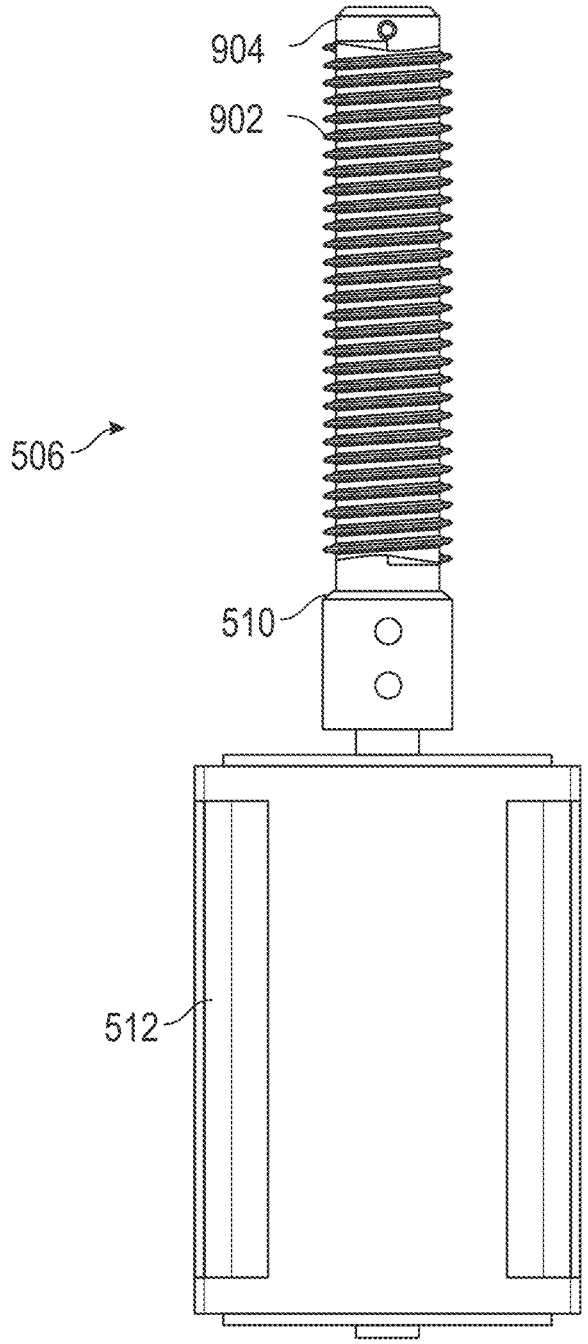
FIG. 9 is a top view of the retraction mechanism of FIG. 5 according to some examples.

FIG. 9 is a top view of the retraction mechanism 506 of FIG. 5 according to some examples. In use, the retractable cables wind and unwind on a long tubular threaded spool 510, which is coupled directly to the shaft of the motor 512, which is a brushless AC electric motor in some examples. The threaded spool 510 converts the torque and rotation of the motor 512 into tension and linear movement of the cable 202 in use.

A helical groove 902 on the threaded spool 510 is sized to receive the cable 202 and ensures that the cable 202 winds smoothly onto and off the threaded spool 510 without overlap. The cable 202 is secured at the far end 904 of the threaded spool 510 in some examples. The width of the groove 902 matches the nominal thickness of the cable 202. The helical groove in the threaded spool 510 can be clockwise or anti-clockwise along the length looking from the direction of the motor, depending on the desired direction of rotation of the threaded spool 510. When fully retracted, approximately 9 feet of cable 202 is wound on the threaded spool 510 to provide enough cable length for a user with a height of 6 feet 6 inches and proportionally long arms to hold a bar 116 fully extended vertically above their head as shown in FIG. 3C.

To provide rapid responsiveness and natural feel under cable acceleration (for example when initiating a movement or during a directional change during a movement, it is desirable that the motor and the threaded spool 510 have relatively low rotational inertia. Furthermore, additional rotating components such as gears or pulleys or belts or chains, especially with substantial mass and a large outer diameter, will add to the net rotational inertia of a rotating mechanism. Gearboxes additionally have backlash (also known as play or slop), which refers to the angle that the output shaft of a gearhead can rotate without the input shaft moving. Backlash can create noise and reduce responsiveness. The use of a direct drive motor without any gears, pulleys or sprockets or belts or chains between the motor 512 and the threaded spool 510 provides a low moment of inertia without backlash between the motor 512 and the threaded spool 510. In some examples, the groove 902 may be fabricated directly into an extended shaft that protrudes from the motor 512.

The retraction mechanism 506 needs to create a relatively high force, for example up to 150 lbs on each cable 202, for a total maximum force of 300 lbs on the bar 116 in barbell mode. The maximum torque required can be determined by multiplying the required force by the radial distance from the center axis of the threaded spool 510 to the center of the cable 202 on the threaded spool 510. To create the required relatively high force, either the peak torque capacity of the motor 512 needs to be relatively high or the radius of spool needs to be relatively low. As the torque increases, motors become bigger, heavier and more expensive. To keep the cost and the weight of the exercise device 102 down, a light weight and low-torque motor is desirable, which requires that the radius of the threaded spool 510 be kept quite small, allowing relatively high force generation using a relatively small and low-torque motor.

As the radius of a conventional spool becomes smaller, problems can arise with the number of turns required to accommodate a long cable. This can result in the cable overlapping itself or require the provision of special winding mechanisms. To resolve these challenges, the threaded spool 510 is designed to be an elongated rod or tube, with the length of the threaded spool 510 being defined by the length of cable wrapped in the helical groove of the spool. In some examples the length of the groove is a multiple (integer or non-integer) of at least twice its diameter.

With a spool having a thread to accommodate the cable, such as the threaded spool 510, the spool can become quite long to accommodate the approximately 9 feet of cable. A long spool can cause problems as the span between the cable being fully wound and fully unwound on the spool can become significant. There is also a certain limit to how wide (front to back) the exercise device 102 can be while still retaining a desirable form factor. Additionally, the platform 106 is quite low for user convenience, and does not itself provide sufficient room for a retractor mechanism. The dimensions of the threaded spool 510 will thus depend on a number of factors, including the width (front to back) of the exercise device 102, the desired size of the side pods 108, the bending forces that the threaded spool 510 will need to endure when the cable is under maximum design load at the far end 904 of the threaded spool 510, motor size, torque and speed requirements, and so forth.

In one example, with a maximum motor torque of 7 Nm, a cable length to unspool of 9 feet and a spool pitch of 4 mm, the required 150 lb. force can be generated with a spool having a diameter of 21 mm, with a helix length of 167 mm and an overall spool length of 219 mm to accommodate the cable length. In this case the spool length is thus approximately ten times the spool diameter, although it will be appreciated that other integer or non-integer multiples are possible. Preferably the spool length is at least five times the spool diameter, but no less than twice the spool diameter.

Figure 10:
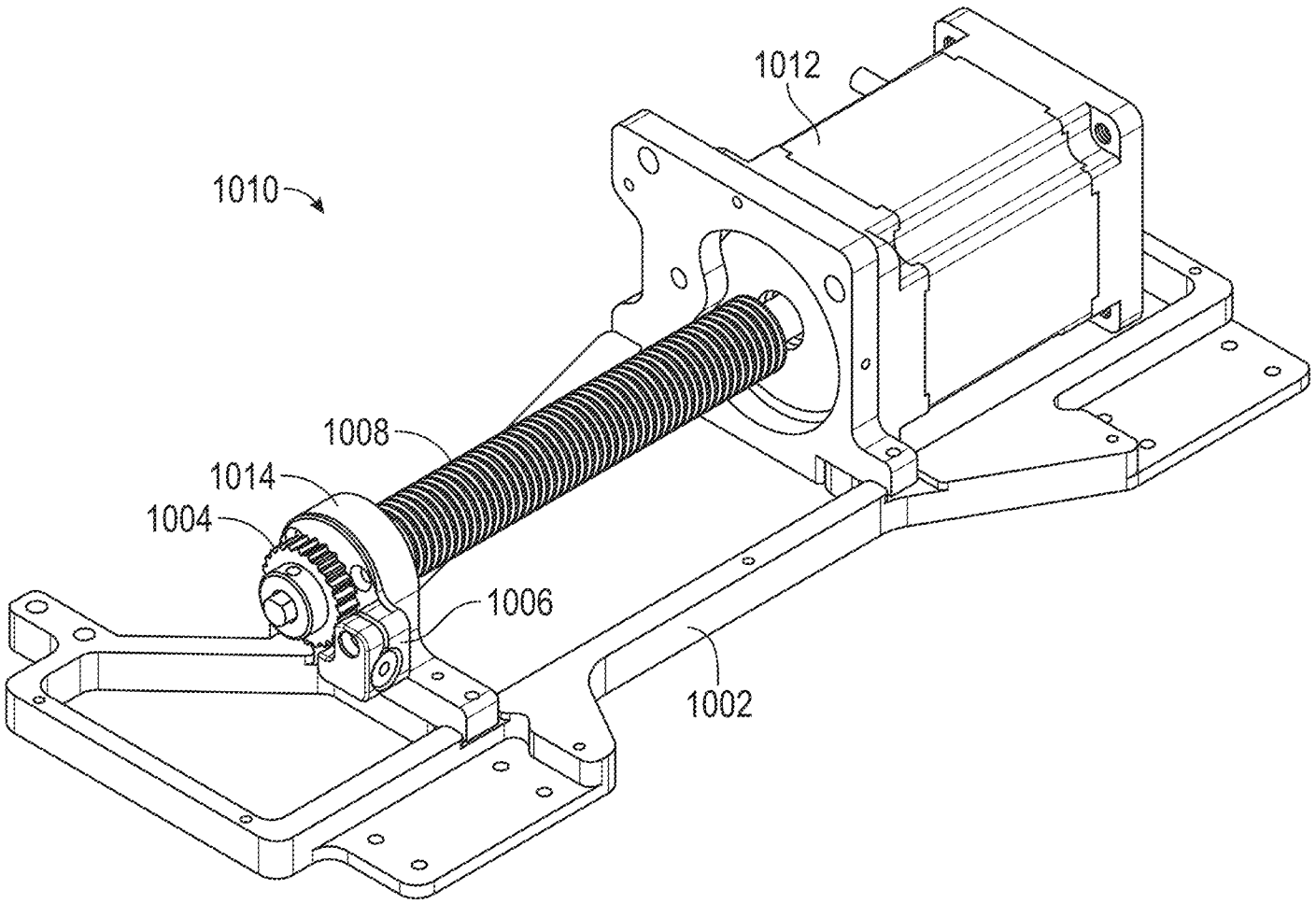
FIG. 10 is a perspective view of a retraction mechanism according to some examples.

FIG. 10 is a perspective view of a retraction mechanism 1010 according to some further examples. As before, the retractable cables wind and unwind on a long tubular threaded spool 1008, which is coupled directly to the shaft of the motor 1012, which is a brushless AC electric motor in some examples. The threaded spool 1008 converts the torque and rotation of the motor 1012 into tension and linear movement of the cable 202 in use. The motor 1012 is mounted to a frame 1002, which is in turn mounted to a chassis of the exercise device 102/402. The end of the threaded spool 1008 remote from the motor 1012 is coupled to the frame 1002 by a bearing mounted in a bearing bracket 1014. This bearing reduces or eliminates bending forces on the threaded spool 1008 and shaft of the motor 1012, which would otherwise have to be absorbed by the motor 1012.

Known exercise devices using an electric motor and a spool but are not powered by batteries, but need to always stay connected to a wall outlet to keep the end point of the cable, which may or may not be attached to a bar or handle, retracted when not in use. If the power is interrupted, the cable end can extend under the weight of a handle or bar, or can easily be pulled out. Additionally, if the device is left unpowered or powered down at the default minimal cable retraction force, a child can pull on the cable and risk entanglement. Some devices, when in the powered down state, can be powered up by pulling on the cord, which may result in an unexpected retraction force.

The retraction mechanism 1010 includes a locking safety mechanism 1006 that prevents withdrawal of a cable from the side pods 108/408 unless the exercise device is powered on and enabled. The safety mechanism 1006 is located outboard of the bearing bracket 1014, and enablement of the device is typically done by an adult through the set top box 1508 via the television remote control 1512 (see FIG. 15) or an application on a client device 1504 when the user wants to exercise, in conjunction with other contextual factors. The safety mechanism 1006 remains or enters a default locked position when not affirmatively activated or in the case of power loss to the exercise device 102/402 or to the retraction mechanism 1010, by engaging a ratchet wheel or gear 1004 mounted to the shaft of the motor 1012.

The safety mechanism 1006 needs to be powered up by the embedded processor 1112 and the battery pack 1120 (see FIG. 11) to unlock the safety mechanism 1006, which ensures that the safety mechanism 1006 auto-locks the threaded spool 1008 in case of a battery failure or fault event. An application on the set top box 1508 or a client device 1504 can also provide a signal to power down or auto-lock the safety mechanism 1006 in case of a timer expiry that triggers power down or the entering of a disabled state if the exercise device 102/402 is left unused for more than a specified time period.

Figure 11:
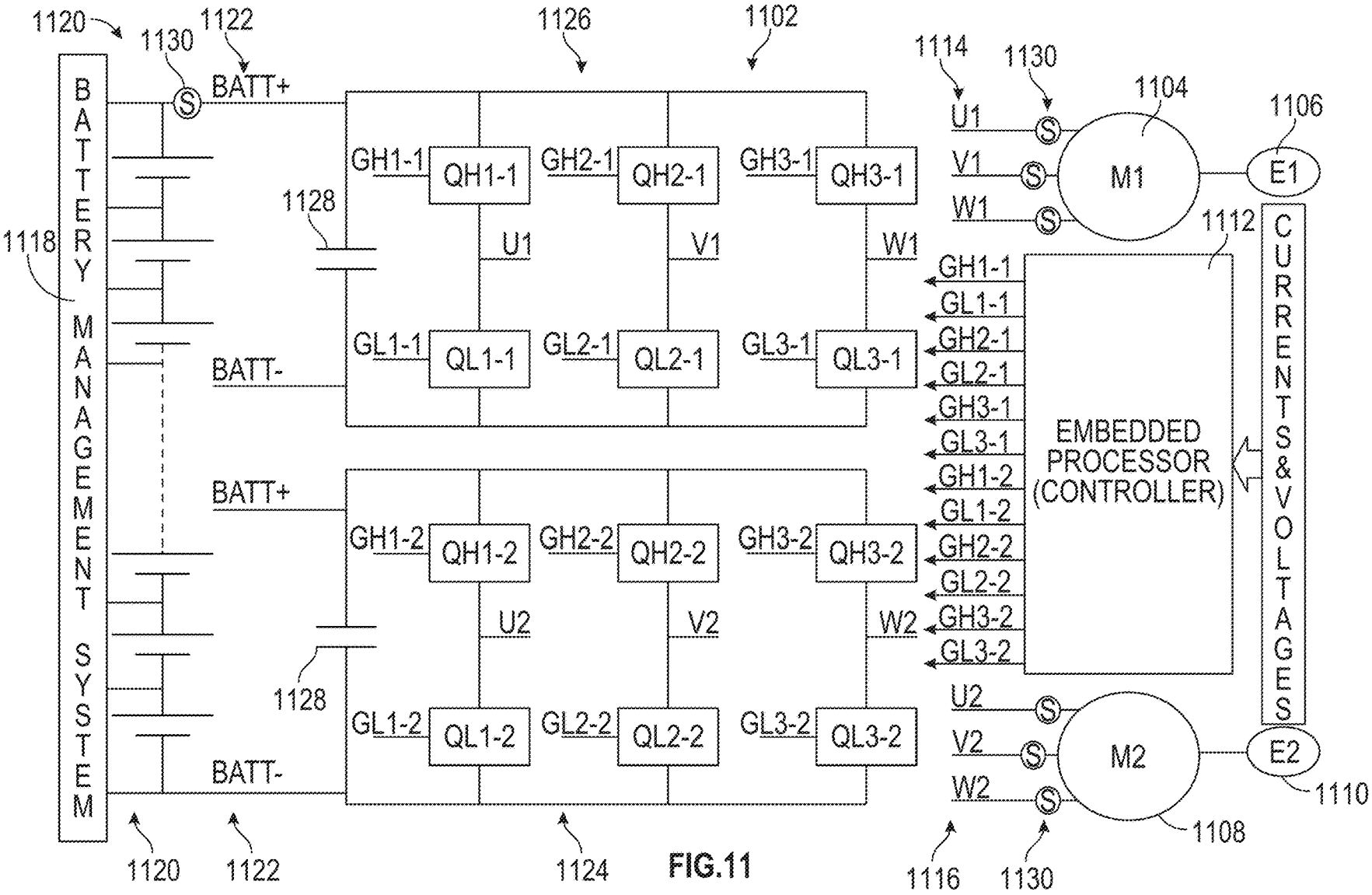
FIG. 11 illustrates an electrical control system and related components for the exercise device according to some examples.

FIG. 11 illustrates an electrical control system 1102 and related components for the exercise device 102 according to some examples. Illustrated in FIG. 11 are a left motor 1104 with a left encoder 1106 and left motor terminals 1114, a right motor 1108 with a right encoder 1110 and right motor terminals 1116, an embedded processor 1112 (microcontroller), a rechargeable battery pack 1120 with a battery management system 1118, and a left motor hex bridge inverter 1126 and a right motor hex bridge inverters 1124. The battery terminals 1122 are coupled to the hex bridge inverter 1124 and hex bridge inverter 1126, which are in turn coupled to the left motor terminals 1114 and right motor terminals 1116 respectively. The hex bridge inverter 1126 and hex bridge inverter 1124 are each independently controlled by the embedded processor 1112 to provide a current through each motor that will generate a required torque in the left motor 1104 and right motor 1108 respectively.

The control system 1102 for an AC motor is often called as an inverter as it takes DC voltage and coverts it into three phase AC voltage that then drives the AC motor. The control system 1102 comprises a dual inverter that can independently drive the left motor 1104 and right motor 1108. The embedded processor 1112 manages the exercise device 102 using seven sensors 1130 for current and voltage (one on each winding of each motor and one on the DC input bus current), a left encoder 1106 for the left motor 1104 and a right encoder 1110 for the right motor 1108. The embedded processor 1112 sends pulse-width modulation signal commands separately to the hex bridge inverter 1124 and hex bridge inverter 1126, each of which comprise 6 electronic MOSFET switches.

The DC inputs from the battery terminals 1122 to the hex bridge inverter 1126 and hex bridge inverter 1124 each include a DC link capacitor 1128 to reduce higher frequency voltage and current ripple. If the PWM frequency is less than 20 khz, audible motor noise may be created due to the creation of vibrations at frequencies that are audible to humans. Accordingly, the PWM frequency used by the embedded processor 1112 is greater than 20 kHz and can for example fall within a range of 30-60 khz. Higher PWM frequencies also create cleaner sinusoidal current waveforms with less torque ripple in low inductance motors, which can further reduce audible noise and improves motor efficiency. Motors that have quicker responses will often have very low inductance and are desirable in an application like this to provide quick responsiveness. The switching losses in the MOSFET switches increases with higher PWM frequencies, hence the gate drive circuit for each MOSFET is designed carefully in the PCB layout and configured to reduce gate ringing and switching losses in the MOSFETs To provide a DC input power source, a battery pack 1120 is used instead of a DC power supply. In use, the exercise device 102 may draw high power from the battery pack 1120 for short periods of time during movement of the bar 116 or handles 114 in one direction, with a quick return to low power or no power when moving in the other direction. The power draw is usually higher while the cable 202 is being retracted, compared to when the cable 202 is being withdrawn. Each motor may act as generator while the user is lifting the bar 116 or a handle 114, thus consuming low power or even negative power. Negative power draw means that current tends to flow back from the motor to the inverter and the DC power source.

Standard DC power supplies that run off the electrical grid are normally unable to receive current or power in such situations as they are usually unidirectional by design. Hence, the excess power is diverted to power resistors to dissipate as heat. If the excess power is not diverted, the DC bus voltage in the DC link capacitors 1128 can rise to high levels leading to permanent damage to the capacitors and/or the MOSFETs and/or the power supply. Bidirectional power supplies exist that return power to the electrical grid, but they are heavy and expensive.

Using a battery pack 1120 as the power source permits power to be returned to the battery pack 1120, which avoids the need for power resistors, keeps the exercise device 102 cooler and also proves to be energy efficient. Additionally, battery packs 1120 are good at providing high current levels for short periods of time due to their lower internal resistance. The size and cost of the battery is thus not defined by the peak power requirement but instead by the total energy consumed. Hence, using a battery pack 1120 instead of a DC power supply can make the exercise device 102 cheaper and lighter. The size and cost of a DC power supply is defined by the peak power requirement, which makes them heavier and expensive.

Additionally, use of the exercise device 102 is made more convenient and flexible by providing a battery pack 1120 instead of a DC power supply, which needs a thick power cord connected to the power outlet, and that brings high voltage AC down to the device and corresponding safety concerns especially the risk of an electric shock in case of a fault. A long power cord or extension cord can also act as a trip hazard.

A small low voltage DC output trickle charger can be used that slowly charges the battery pack 1120 over a period of time when the device is not in use. The relatively higher voltage from the power outlet just goes to the trickle charger and not the exercise device 102. The charger module can be a wall outlet mount module that may have already been certified. The battery management system 1118 keeps track of the voltages in the cells of the battery pack 1120 during charging and ensures that all cells are evenly charged. The battery management system 1118 keeps track of the battery voltage and disables the exercise device 102 if the battery is almost fully discharged, to protect the battery from permanent damage that may result from over discharging.

The left encoder 1106 and the right encoder 1110 are each multi-turn type encoders that keep track of rotational position changes beyond 360 degrees and they are thus able to provide an output that is proportional to length of unspooled cable 202 outwards on both sides of the exercise device 102. This permits measurement of the height of the bar 116 or handle 114 above the platform 106, permitting actuation of an exercise force only at a certain height. When using a traditional barbell, for exercises like an overhead press, the user needs to first place the barbell on the studs of a squat rack at a certain height and has to load the weights onto the barbell before the exercise can be performed. This ensures the force start point is set at the certain height above the floor and the exercise is always performed at a height above this start point. The user can also easily return the barbell to the squat rack at end of the exercise or during the exercise if they are struggling, without risking injury.

The left and right encoders 1106, 1110 can also be used to maintain horizontal stability of the bar 116, to ensure a consistent, symmetric range of motion for both sides of the user's body, and also to compensate for a situation in which one arm or side of the body is weaker than the other.

Figure 12:
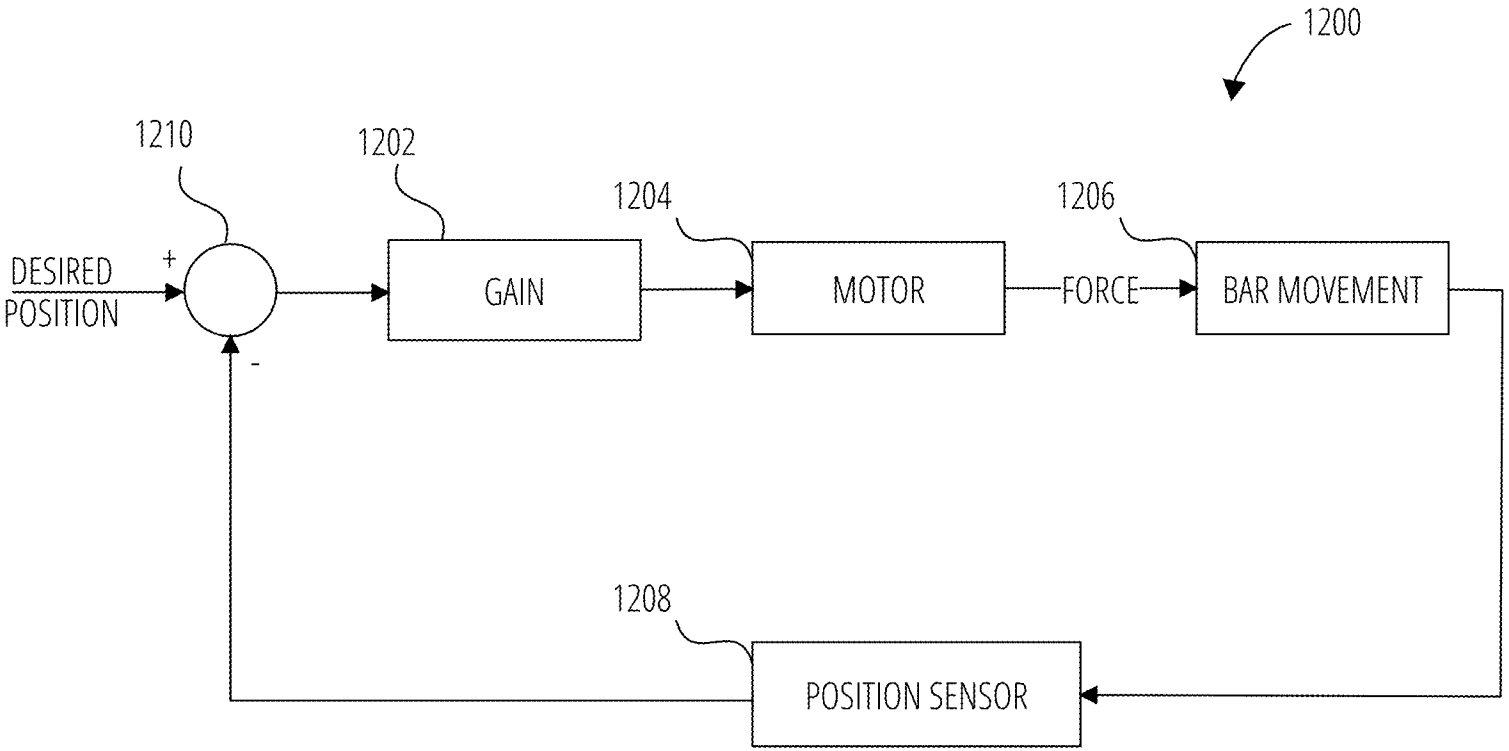
FIG. 12 illustrates the a feedback loop for maintaining bar stability according to some examples.

FIG. 12 illustrates the a feedback loop 1200 for maintaining bar stability according to some examples. A desired position value is received at summing junction 1210 and has the actual position, as measured by a position sensor 1208, subtracted from it. The difference is multiplied by a gain 1202, which is applied to the motor 1204 to increase or decrease the torque generated by the motor, depending on the sign of the difference. The torque generated by the motor creates a corresponding force in a cable, which results in an associated bar movement 1206. The position of the bar is again measured by the position sensor 1208. In some examples the position sensor 1208 is either one of the left encoder 1106 and the right encoder 1110 and the desired position received at the summing junction 1210 is generally the other one of the left encoder 1106 and right encoder 1110.

The output of the position sensor is again compared with a current desired position at summing junction 1210, and the control loop proceeds from there.

The gain 1202 is provided to both the left motor 1104 and the right motor 1108 with a reversed sign, so that the decrease in force on one cable 202 is mirrored by an increased force on the other cable 202, with the decreased force (negative gain) being applied to the lower height and the increased force (positive gain) being applied to the higher height.

Figure 13:
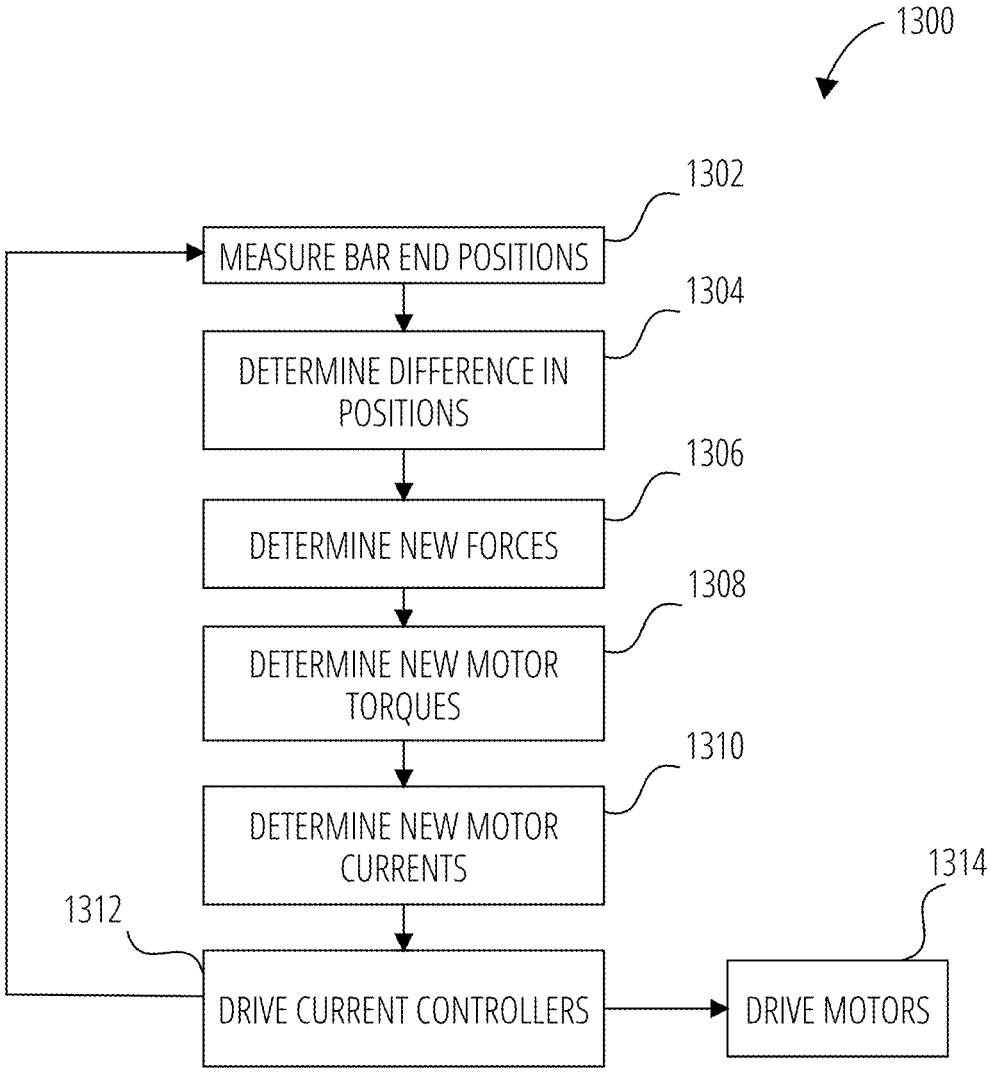
FIG. 13 illustrates a flowchart for maintaining bar stability according to some examples.

FIG. 13 illustrates a flowchart 1300 for maintaining bar stability according to some examples. For explanatory purposes, the operations of the flowchart 1300 are described herein as occurring in serial, or linearly. However, multiple operations of the flowchart 1300 may occur in parallel. In addition, the operations of the flowchart 1300 need not be performed in the order shown and/or one or more blocks of the flowchart 1300 need not be performed and/or can be replaced by other operations. Also provided is a non-transitory computer-readable storage medium, the computer-readable storage medium including instructions that when executed by a computer, cause the computer to perform one or more of the operations in flowchart 1300.

The method may execute for example on a combination of the exercise device 102 and an application running on a client device 1504 with which the exercise device 102 is paired, although many variations are possible, including running entirely on the exercise device 102 or with some of the method steps being performed on, or associated data being retrieved from, a remote location such as a server 1502. For the purposes of describing the flowchart 1300, the exercise device 102 and any associated devices that may be involved in the method are referred to as "the system."

Additionally, the flowchart 1300 is described herein with reference to the tension in the cables 202 when the exercise is being performed with a bar 116. It will be appreciated that the flowchart also applies to the tension in the cables 202 if an exercise is performed with handles 114, although the stabilization feature can be disabled for a situation in which a user is exercising using only one handle 114, or the movements of the handles 114 are out of synchronization, such as in alternating dumbbell curls. The stabilization feature can be disabled by user selection or by the system based on the type of exercise selected.

The method begins at operation 1302 with the receipt by the system of positional information provided by the left encoder 1106 and the right encoder 1110. The positional information represents or is proportional to how far each of the cables 202 have been extended from the side pods 108, and thus the height or position of the ends of the bar 116 above the platform 106, $P_L$ and $P_R$. $P_L$ and $P_R$ may for example be radial positions measured by the left encoder 1106 and the right encoder 1110 or may be linear values derived therefrom. In operation 1304, the difference between the two positions is determined as $\Delta=P_L-P_R$.

In operation 1306, new cable tension forces for the two motors are estimated as $F_L(\text{new})=F_L(\text{prev})-K*\Delta$ and $F_R(\text{new})=F_R(\text{prev})+K*\Delta$, where K is the gain in the PID controller used to control the forces in the cables. The new motor torques are then determined in operation 1308 as $T_L=F_L(\text{new})*R_{SPOOL}$ and $T_R=F_R(\text{new})*R_{SPOOL}$, where $R_{SPOOL}$ is the effective radius of the threaded spool 510. As can be seen from these equations, the amount of the adjustment will be opposite in sign but equal in magnitude for $F_L(\text{new})$ and $F_R(\text{new})$, the sign depending on which cable 202 is extended further than the other one.

The motor current for each motor is then determined in operation 1310 as $I_L=(1/K_M)*T_L$ and $I_R=(1/K_M)*T_R$, where $K_M$ is the motor torque constant. The current values $I_L$ and $I_R$ are then provided to the motor controllers in operation 1312, which in turn drive the motors in operation 1314. The flowchart 1300 then returns to operation 1302 and proceeds from there.

Figure 14:
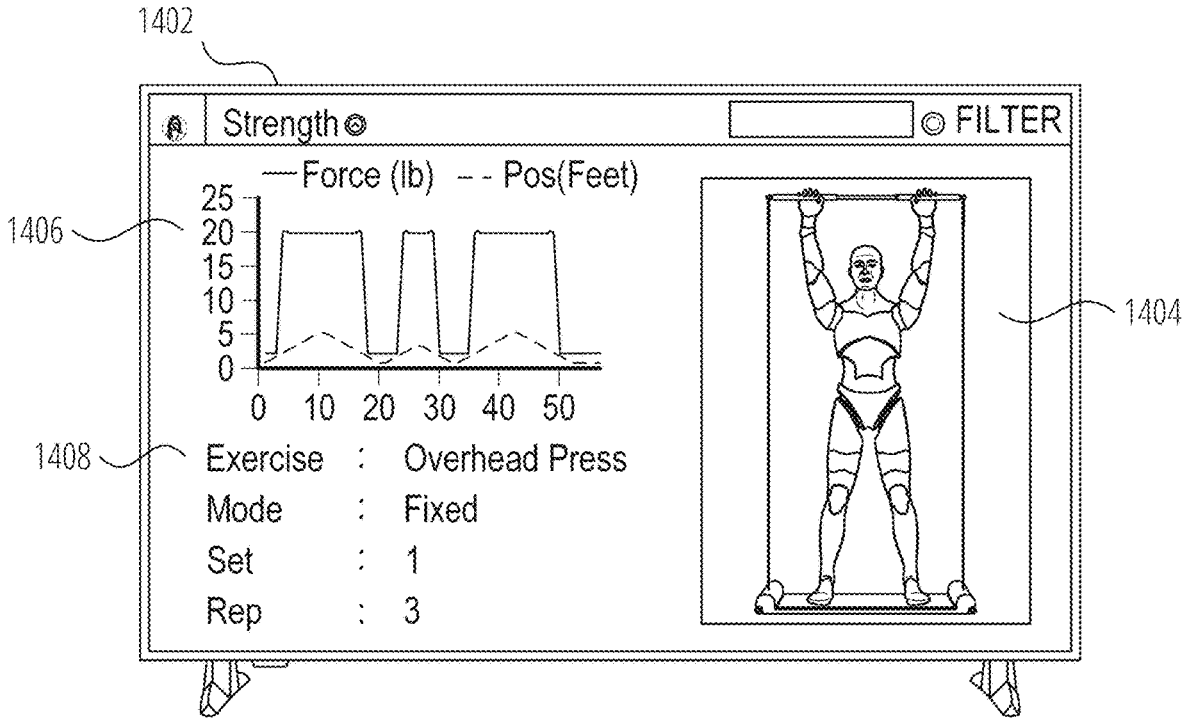
FIG. 14 illustrates a display that may be shown on a related display device during use of the exercise device, according to some examples.

FIG. 14 illustrates a display that may be shown on a related display device 1402 during use of the exercise device 102, according to some examples. The display includes a window with a video feed 1404 from a camera located in or on the display device 1402 and pointed at the user, so that they can monitor their form during the exercise. Alternatively, an instructor or avatar can be shown instead, to provide guidance to the user. The display also includes a chart 1406 showing the height of the bar 116 over time, as well as a display of the force applied to the bar over time. The display also includes a status display 1408 that shows the selected exercise, the exercise mode (such as fixed force or height or speed adaptive), the number of sets of the exercise that have been done in the current session, and the number of repetitions done in the current set of the exercise.

Figure 15:
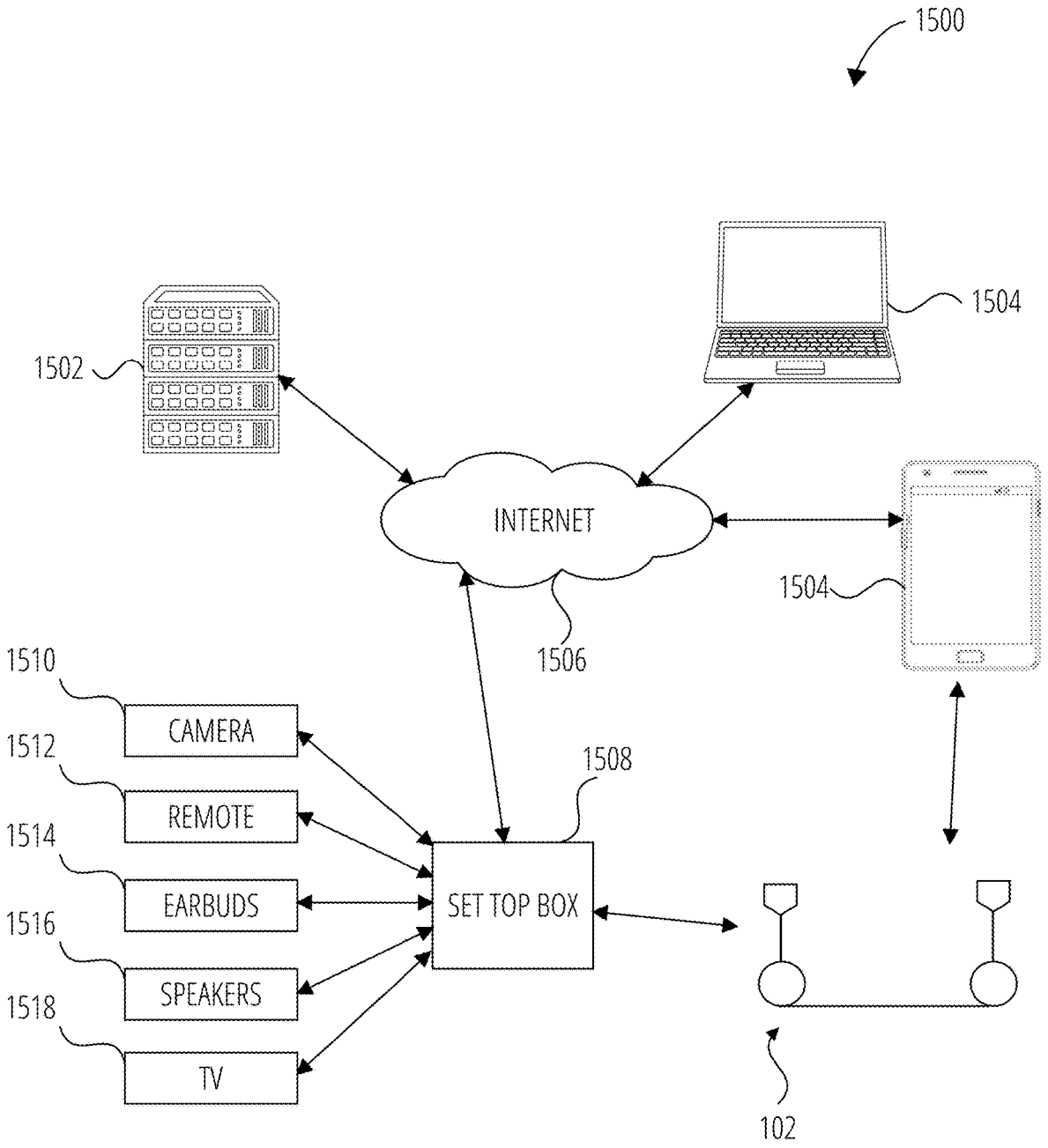
FIG. 15 illustrates a system including an exercise device, a server, and various client devices according to some examples.

FIG. 15 illustrates a system 1500 including an exercise device 102, a server 1502, and client devices 1504 according to some examples. In various examples, the client devices 1504 may include desktop PCs, mobile phones, laptops, tablets, wearable computers, smart televisions or other computing devices that are capable of connecting to the Internet 1506 and communicating with the server 1502, such as described herein. The client device 1504 may be paired with the exercise device 102 using a Bluetooth connection, to provide a user interface by means of which a user of the exercise device 102 can manage the exercise device 102, as well as to receive feedback on their use of the exercise device 102.

A mobile phone or a tablet computer may be a suitable client device 1504 for use with the exercise device 102, since these devices have a touch screen for display and user input, a Bluetooth adapter for communication with the exercise device 102, a Wi-Fi adapter for connection to the Internet 1506, and a camera and microphone for video communication. An application running on a mobile phone or tablet computer can thus do all the data processing, relaying of logged data to the server 1502, as well as streaming of video or other audio content from the Internet, and communicating with the users of other exercise devices 102 or with remote personal trainers. Such an application can also be used to control the exercise device 102 to select exercise types and levels, select different user profiles for the exercise device 102, and track and display information about the user's current session and overall progress as shown in FIG. 14.

Another suitable device for use with the exercise device 102 is a set top box 1508 with an associated television 1518 or monitor. The set top box 1508 is a smart, internet-connected device with an inbuilt computer capable of running an application to provide the capabilities described above with reference to the client device 1504. Some examples of such a set-top box are Amazon Fire TV cube, Amazon fire TV stick, Google Chromecast TV, and so forth.

The television 1518 may also be a smart television that has set top box functionality built in, in which case a separate set top box 1508 may not be required.

The set top box 1508 provides a video signal to the TV over HDMI or other display protocol. The set top box 1508 and/or a smart television 1518 may be preferred over a smartphone or a tablet because they can be controlled by a remote control 1512 that can be used from a distance, provide a larger display, and may be easier to use, especially for the elderly. Wireless connectivity like Bluetooth, Wi-Fi, etc. are typically available on current smart televisions or set-top boxes, or can be easily added via a USB interface. Such connections can again be used to exchange data between remote servers 1502, the exercise device 102 and to communicate with workout partners or personal trainers over the Internet 1506

For video communication, a camera 1510 may be in-built into the set-top set top box 1508 or the television 1518 TV. Alternatively, a camera with a wired USB interface can be connected to a USB interface on the set-top set top box 1508 or smart television 1518. Audio output can be provided by earbuds 1514 connected to the set top box 1508 or the smart television 1518, or by wired or wireless speakers 1516. A microphone may be built into the camera, the set-top box, may be connected to the set-top set top box 1508 via USB, or be included in wireless earbuds connected through Bluetooth.

Various examples are contemplated. Example 1 is a method of operating an exercise device including a first motor, a second motor, a first spool coupled to the first motor, a second spool coupled to the second motor, a first cable coupled to the first spool for winding onto and off the first spool in response to a torque applied by the first motor, a second cable coupled to the second spool for winding onto and off the second spool in response to a torque applied by the second motor, the method comprising: determining a first value related to an extension of the first cable from the first spool; determining a second value related to an extension of the second cable from the second spool; determining a difference between the first value and the second value; and adjusting the torque applied by at least one of the first motor and the second motor based on the difference between the first value and the second value.

In Example 2, the subject matter of Example 1 includes, wherein the adjusting of the torque applied by at least one of the first motor and the second motor comprises: increasing the torque applied by the first motor if the first value is less than the second value; and decreasing the torque applied by the first motor if the first value is greater than the second value.

In Example 3, the subject matter of Examples 1-2 includes, wherein the torque applied by the at least one of the first motor and the second motor is adjusted based on the difference between the first value and the second value.

In Example 4, the subject matter of Examples 1-3 includes, wherein the torques of both of the first motor and the second motor are adjusted.

In Example 5, the subject matter of Example 4 includes, wherein an adjustment of the torque of the first motor is equal in magnitude but opposite in sign to an adjustment of the torque of the second motor.

In Example 6, the subject matter of Examples 1-5 includes, disabling the adjusting of the torque applied by at least one of the first motor and the second motor based on the difference between the first value and the second value based on user input.

In Example 7, the subject matter of Examples 1-6 includes, disabling the adjusting of the torque applied by at least one of the first motor and the second motor based on the difference between the first value and the second value based on exercise type.

Example 8 is a non-transitory computer-readable storage medium, the computer-readable storage medium including instructions that when executed by a computer, cause the computer to perform operations for operating an exercise device including a first motor, a second motor, a first spool coupled to the first motor, a second spool coupled to the second motor, a first cable coupled to the first spool for winding onto and off the first spool in response to a torque applied by the first motor, a second cable coupled to the second spool for winding onto and off the second spool in response to a torque applied by the second motor, the operations comprising: determining a first value related to an extension of the first cable from the first spool; determining a second value related to an extension of the second cable from the second spool; determining a difference between the first value and the second value; and adjusting the torque applied by at least one of the first motor and the second motor based on the difference between the first value and the second value.

In Example 9, the subject matter of Example 8 includes, wherein the adjusting of the torque applied by at least one of the first motor and the second motor comprises: increasing the torque applied by the first motor if the first value is less than the second value; and decreasing the torque applied by the first motor if the first value is greater than the second value.

In Example 10, the subject matter of Examples 8-9 includes, wherein the torque applied by the at least one of the first motor and the second motor is adjusted based on the difference between the first value and the second value.

In Example 11, the subject matter of Examples 8-10 includes, wherein the torques of both of the first motor and the second motor are adjusted.

In Example 12, the subject matter of Example 11 includes, wherein an adjustment of the torque of the first motor is equal in magnitude but opposite in sign to an adjustment of the torque of the second motor.

In Example 13, the subject matter of Examples 11-12 includes, wherein the operations further comprise disabling the adjusting of the torque applied by at least one of the first motor and the second motor based on the difference between the first value and the second value based on user input.

In Example 14, the subject matter of Examples 11-13 includes, wherein the operations further comprise disabling the adjusting of the torque applied by at least one of the first motor and the second motor based on the difference between the first value and the second value based on exercise type.

Example 15 is an exercise system including: a processor, a first motor, a first spool coupled to the first motor, a first cable coupled to the first spool for winding onto and off the first spool in response to a torque applied by the first motor, a second motor, a second spool coupled to the second motor, a second cable coupled to the second spool for winding onto and off the second spool in response to a torque applied by the second motor, the processor including instruction that cause the exercise system to perform operations for operating the exercise system, the operations comprising: determining a first value related to an extension of the first cable from the first spool; determining a second value related to an extension of the second cable from the second spool; determining a difference between the first value and the second value; and adjusting the torque applied by at least one of the first motor and the second motor based on the difference between the first value and the second value.

In Example 16, the subject matter of Example 15 includes, wherein the adjusting of the torque applied by at least one of the first motor and the second motor comprises: increasing the torque applied by the first motor if the first value is less than the second value; and decreasing the torque applied by the first motor if the first value is greater than the second value.

In Example 17, the subject matter of Examples 15-16 includes, wherein the torque applied by the at least one of the first motor and the second motor is adjusted based on the difference between the first value and the second value.

In Example 18, the subject matter of Examples 15-17 includes, wherein the torques of both of the first motor and the second motor are adjusted.

In Example 19, the subject matter of Example 18 includes, wherein an adjustment of the torque of the first motor is equal in magnitude but opposite in sign to an adjustment of the torque of the second motor.

In Example 20, the subject matter of Examples 18-19 includes, wherein the operations further comprise disabling the adjusting of the torque applied by at least one of the first motor and the second motor based on the difference between the first value and the second value based on user input or based on exercise type.

Example 21 is at least one machine-readable medium including instructions that, when executed by processing circuitry, cause the processing circuitry to perform operations to implement of any of Examples 1-20.

Example 22 is an apparatus comprising means to implement of any of Examples 1-20. Example 23 is a system to implement of any of Examples 1-20. Example 24 is a method to implement of any of Examples 1-20.

As referred to herein, the term non-transitory machine-readable medium refers to a single or multiple storage devices and/or media (e.g., a centralized or distributed database, and/or associated caches and servers) that store executable instructions and/or data. The terms shall accordingly be taken to include, but not be limited to, solid-state memories, and optical and magnetic media, including memory internal or external to processors. Specific examples of machine-storage media, computer-storage media and/or device-storage media include non-volatile memory, including by way of example semiconductor memory devices, e.g., erasable programmable read-only memory (EPROM), electrically erasable programmable read-only memory (EEPROM), FPGA, and flash memory devices (external or internal to processor); magnetic disks such as internal hard disks and removable disks; magneto-optical disks; and CD-ROM and DVD-ROM disks.

Changes and modifications may be made to the disclosed examples without departing from the scope of the present disclosure. These and other changes or modifications are intended to be included within the scope of the present disclosure, as expressed in the following claims as filed or amended.

What is claimed is:

1. A method of operating an exercise device including a first motor, a second motor, a first spool coupled to the first motor, a second spool coupled to the second motor, a first cable coupled to the first spool for winding onto and off the first spool in response to a torque applied by the first motor, a second cable coupled to the second spool for winding onto and off the second spool in response to a torque applied by the second motor, the method comprising:

determining a first value related to an extension of the first cable from the first spool;

determining a second value related to an extension of the second cable from the second spool;

determining a difference between the first value and the second value; and adjusting the torque applied by at least one of the first motor and the second motor based on the difference between the first value and the second value.

2. The method of claim 1, wherein the adjusting of the torque applied by at least one of the first motor and the second motor comprises:

increasing the torque applied by the first motor if the first value is less than the second value; and decreasing the torque applied by the first motor if the first value is greater than the second value.

3. The method of claim 1, wherein the torque applied by the at least one of the first motor and the second motor is adjusted based on the difference between the first value and the second value.

4. The method of claim 1, wherein the torques of both of the first motor and the second motor are adjusted.

5. The method of claim 4, wherein an adjustment of the torque of the first motor is equal in magnitude but opposite in sign to an adjustment of the torque of the second motor.

6. The method of claim 1, further comprising:

disabling the adjusting of the torque applied by at least one of the first motor and the second motor based on the difference between the first value and the second value based on user input.

7. The method of claim 1, further comprising:

disabling the adjusting of the torque applied by at least one of the first motor and the second motor based on the difference between the first value and the second value based on exercise type.

8. A non-transitory computer-readable storage medium, the computer-readable storage medium including instructions that when executed by a computer, cause the computer to perform operations for operating an exercise device including a first motor, a second motor, a first spool coupled to the first motor, a second spool coupled to the second motor, a first cable coupled to the first spool for winding onto and off the first spool in response to a torque applied by the first motor, a second cable coupled to the second spool for winding onto and off the second spool in response to a torque applied by the second motor, the operations comprising:

determining a first value related to an extension of the first cable from the first spool;

determining a second value related to an extension of the second cable from the second spool;

determining a difference between the first value and the second value; and adjusting the torque applied by at least one of the first motor and the second motor based on the difference between the first value and the second value.

9. The non-transitory computer-readable storage medium of claim 8, wherein the adjusting of the torque applied by at least one of the first motor and the second motor comprises:

increasing the torque applied by the first motor if the first value is less than the second value; and decreasing the torque applied by the first motor if the first value is greater than the second value.

10. The non-transitory computer-readable storage medium of claim 8, wherein the torque applied by the at least one of the first motor and the second motor is adjusted based on the difference between the first value and the second value.

11. The non-transitory computer-readable storage medium of claim 8, wherein the torques of both of the first motor and the second motor are adjusted.

12. The non-transitory computer-readable storage medium of claim 11, wherein an adjustment of the torque of the first motor is equal in magnitude but opposite in sign to an adjustment of the torque of the second motor.

13. The non-transitory computer-readable storage medium of claim 11, wherein the operations further comprise disabling the adjusting of the torque applied by at least one of the first motor and the second motor based on the difference between the first value and the second value based on user input.

14. The non-transitory computer-readable storage medium of claim 11, wherein the operations further comprise disabling the adjusting of the torque applied by at least one of the first motor and the second motor based on the difference between the first value and the second value based on exercise type.

15. An exercise system including:

a processor, a first motor, a first spool coupled to the first motor, a first cable coupled to the first spool for winding onto and off the first spool in response to a torque applied by the first motor, a second motor, a second spool coupled to the second motor, a second cable coupled to the second spool for winding onto and off the second spool in response to a torque applied by the second motor, the processor including instruction that cause the exercise system to perform operations for operating the exercise system, the operations comprising:

determining a first value related to an extension of the first cable from the first spool;

determining a second value related to an extension of the second cable from the second spool;

determining a difference between the first value and the second value; and adjusting the torque applied by at least one of the first motor and the second motor based on the difference between the first value and the second value.

16. The exercise system of claim 15, wherein the adjusting of the torque applied by at least one of the first motor and the second motor comprises:

increasing the torque applied by the first motor if the first value is less than the second value; and decreasing the torque applied by the first motor if the first value is greater than the second value.

17. The exercise system of claim 15, wherein the torque applied by the at least one of the first motor and the second motor is adjusted based on the difference between the first value and the second value.

18. The exercise system of claim 15, wherein the torques of both of the first motor and the second motor are adjusted.

19. The exercise system of claim 18, wherein an adjustment of the torque of the first motor is equal in magnitude but opposite in sign to an adjustment of the torque of the second motor.

20. The exercise system of claim 18, wherein the operations further comprise disabling the adjusting of the torque applied by at least one of the first motor and the second motor based on the difference between the first value and the second value based on user input or based on exercise type.

* * * * *